US006965358B1

(12) United States Patent
Kasahara et al.

(10) Patent No.: US 6,965,358 B1
(45) Date of Patent: Nov. 15, 2005

(54) APPARATUS AND METHOD FOR MAKING A GRAY SCALE DISPLAY WITH SUBFRAMES

(75) Inventors: Mitsuhiro Kasahara, Hirakata (JP); Yuichi Ishikawa, Tbaraki (JP); Tomoko Morita, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/623,452

(22) PCT Filed: Jan. 18, 2000

(86) PCT No.: PCT/JP00/00193

§ 371 (c)(1),
(2), (4) Date: Sep. 11, 2000

(87) PCT Pub. No.: WO00/43979

PCT Pub. Date: Jul. 27, 2000

(30) Foreign Application Priority Data

Jan. 22, 1999 (JP) ..... 11-014446

(51) Int. Cl.[7] ..... G09G 3/28
(52) U.S. Cl. ..... 345/63; 315/169.4
(58) Field of Search ..... 345/63, 60, 690, 345/691, 692, 693, 694, 695, 696, 473, 474, 345/475, 148, 147, 600, 602, 584; 348/671; 315/169.4

(56) References Cited

U.S. PATENT DOCUMENTS 6,025,818 A * 2/2000 Okano ..... 345/63
6,144,364 A 11/2000 Otobe et al.
6,369,782 B2 * 4/2002 Shigeta ..... 345/63
6,377,232 B1 4/2002 Chevet et al.
6,456,302 B2 * 9/2002 Kawahara et al. ..... 345/693
6,563,486 B2 * 5/2003 Otobe et al. ..... 345/63

FOREIGN PATENT DOCUMENTS

EP 0893916 1/1999
EP 0924684 6/1999

(Continued)

OTHER PUBLICATIONS

ITEJ Technical Report, ISSN 0386-4227, published Jan. 19, 1995, with partial English translation.

(Continued)

*Primary Examiner*—Alexander Eisen
(74) *Attorney, Agent, or Firm*—Greenblum & Bernstein, P.L.C.

(57) ABSTRACT

The invention provides an apparatus and a method applied to a plasma display panel or other display panel, achieving a gray scale display by using a plurality of weighted subfields. The apparatus comprises a gray scale limiting/difference diffusion circuit (17) for converting gray scale levels in a supplied image signal to specific gray scale levels that do not easily create pseudo contours in moving picture areas and to intermediate gray scale levels between the specific gray scale levels, and diffusing the difference between the converted gray scale level and the original gray scale level to adjacent pixels, and a dither circuit (19) for generating a video signal to display the converted gray scale level from the circuit (17) alternately in even and odd fields. The dither circuit (19) generates the video signal in which the gray scale levels offset the dither level above and below the dithered gray scale are alternately presented when the converted gray scale level is a dithered gray scale.

32 Claims, 8 Drawing Sheets

FOREIGN PATENT DOCUMENTS

| | | |
|---|---|---|
| EP | 1020838 | 7/2000 |
| FR | 2740253 | 4/1997 |
| JP | 10-31455 | 2/1998 |
| JP | 11-85101 | 3/1999 |
| JP | 11259044 | 9/1999 |
| JP | 2000267627 | 9/2000 |

OTHER PUBLICATIONS

English Language Abstract of JP 10-31455.
English Language Abstract of JP 11-85101.
English Language Abstract of JP 2000-267627.
English Language Abstract of JP 11-259044.

* cited by examiner

EVEN FIELD

| | | |
|---|---|---|
| + | − | + |
| − | + | − |
| + | − | + |

ODD FIELD

| | | |
|---|---|---|
| − | + | − |
| + | − | + |
| − | + | − |

EVEN FIELD

| | | |
|---|---|---|
| + | + | + |
| − | − | − |
| + | + | + |

ODD FIELD

| | | |
|---|---|---|
| − | − | − |
| + | + | + |
| − | − | − |

EVEN FIELD

| | | |
|---|---|---|
| + | + | + |
| + | + | + |
| + | + | + |

ODD FIELD

| | | |
|---|---|---|
| − | − | − |
| − | − | − |
| − | − | − |

APPARATUS AND METHOD FOR MAKING A GRAY SCALE DISPLAY WITH SUBFRAMES

TECHNICAL FIELD

The present invention relates to a display apparatus such as a plasma display panel (PDP) or digital mirror device (DMD), and to a related display method, whereby a gray scale display is achieved by dividing a single image field into a plurality of subfields.

BACKGROUND ART

The pixels in plasma display panels and some other types of image display panels can only be driven at two levels, on or off. A so-called subfield method is therefore typically used in such display panels to achieve a display of motion picture with gray scale. This subfield method achieves a gray scale display by dividing each image field into a plurality of two-value subfields weighted for presentation on screen for different time periods. The weight of each subfield corresponds to the light emitted when that subfield is presented. More specifically, each subfield is assigned a luminance weight indicative of the number of times and the period for which pixels are switched on to display the subfield. A desired display luminance is achieved by selecting the combination of subfields which will achieve the desired gray scale.

FIG. 6 shows the time relationship the subfields of a single field in a typical subfield method. In this example, each field is divided into eight subfields, that is, subfields 1 to 8, which are assigned a luminance weight of 1, 2, 4, 8, 16, 32, 64, and 128, respectively. Each subfield is further divided into a set-up period T1, write period T2, and sustain period T3. The set-up period T1 discharges any residual charge in the subfield. Data for turning each pixel of the PDP either on or off is then written in the write period T2. Those pixels that are to be turned on based on the data written in the write period T2 are then turned on all at once during the sustain period T3, and the subfields are turned on in sequence from subfield 1 to subfield 8.

A 256-level display with gray scales from 0 to 255 can be achieved using subfields as shown in FIG. 6 by driving the subfields in various combinations. For example, a gray scale level of 7 can be achieved by turning pixels on for subfields 1 to 3, and a gray scale level of 21 can be achieved by using subfields 1, 3, and 5.

It is therefore possible with this subfield method to time-divide each image field into a plurality of subfields, select from among this plurality of time-divided subfields the subfields needed to achieve a desired gray scale level, and drive the display pixels for the time determined by the selected subfields to present the desired gray scale level.

In display devices using this subfield method are known, however, to suffer from pseudo contours appearing in the motion pictures. These pseudo contours will be further described below.

Let us assume that an image field has been time divided into subfields with weights of 1, 2, 4, 8, 16, 32, 64, and 128, and that image pattern X shown in FIG. 7 moves by two pixels horizontally on PDP screen 33. In addition, image pattern X comprises pixels P1 and P2 with gray scale level of 127, and adjacent pixels P3 and P4 with level of 128. The subfields that are driven to achieve these gray scale levels in image pattern X are shown in FIG. 8. Note that the horizontal direction in FIG. 8 corresponds to the horizontal direction of the PDP screen 33, and time is shown on the vertical direction. The emitting subfields are shaded.

When image pattern X is still, the gray scale level observed by a viewer is determined by the combination of emitting subfields through line A–A', and the image gray scale level is normally perceived as intended. However, when the image pattern X moves horizontally across the screen as indicated in FIG. 7, the viewer's sight line would effectively moves in B–B' or C–C' direction in FIG. 8. When the sight line moves in B–B' direction, the observer sees subfields 1 to 5 of pixel P4, subfields 6 and 7 of pixel P3, subfield 8 of pixel P2. Because these subfields are integrated in time field, the viewer would observe gray scale level 0. Conversely, when the sight line is through C–C', the viewer observes subfields 1 to 5 of pixel P1, subfields 6 and 7 of pixel P2, and subfield 8 of pixel P3. In this case, the viewer would observe gray scale level of 255. More particularly, the perceived gray scale level is significantly different from the intended gray scale level of 127 or 128, and is seen by the human eye as a pseudo contour.

This problem of pseudo contours is particularly pronounced when this method of using weighted subfields is used and the luminance levels of adjacent pixels are 63 and 64, 191 and 192, and similar combinations which require a significant change in the pattern of emitting subfields to achieve a minimal change in gray scale. Contour lines such as these appearing only in moving picture images are known as pseudo contour noise and are a factor in image quality deterioration (see pseudo contour noise appearing in displays of PWM controlled moving pictures, Technical Report of the Inst. of Television Engineers of Japan, Vol. 19, No. 2, IDY95-21, pp. 61–66.).

DISCLOSURE OF INVENTION

The present invention is therefore directed to a display apparatus and display method for reducing pseudo contours in moving picture regions of a video image presented on a plasma display panel or similar two-value display panel in which gray scale expression is achieved by dividing one image field into a plurality of subfields. A display apparatus according to the invention performs gray scale display by dividing one field of picture into a plurality of weighted subfields and by controlling each subfield to emit or not emit based on the gray scale level of pixel in the picture.

The apparatus comprises a conversion unit and a first diffusion unit. The conversion unit selectively converts a gray scale level of the pixel to one gray scale level in a first gray scale group ("display-use gray scale group") or one gray scale level in a second gray scale group ("dithered gray scale group"). The first gray scale group includes a plurality of gray scale levels which is used for actual display. The gray scale level in the first gray scale group is expressed by the combination of the subfields. The second gray scale group includes a plurality of gray scale levels each of which has a value in the middle of the gray scale levels in the first gray scale group. The first diffusion unit generates a video signal. The video signal displays a gray scale level obtained by the conversion unit when the gray scale level obtained by the conversion unit is in the first gray scale group, while the video signal displays a gray scale level in the first gray scale group which is obtained by diffusing a predetermined value corresponding to the gray scale level in the second gray scale group when the gray scale level obtained by the conversion unit is in the second gray scale group.

The first gray scale group may include gray scale levels each of which is achieved by subfields in which there is no non-emitting subfields in subfields having weights less than the greatest weight among weights of the subfields to be emitted for achieving the gray scale level. The first gray scale group may include gray scale levels each of which is achieved by subfields in which there is at most one of non-emitting subfields in subfields having weights less than the greatest weight among weights of the subfields to be emitted for achieving the gray scale level. The first gray scale group may include gray scale levels each of which is achieved by subfields in which there is at most two of non-emitting subfields in subfields having weights less than the greatest weight among weights of the subfields to be emitted for achieving the gray scale level.

The non-emitting subfield may exclude a subfield having the minimum weight. The non-emitting subfield may exclude a subfield having the minimum weight and a subfield having the next succeeding minimum weight. The non-emitting subfield may exclude a subfield having the minimum weight, a subfield having the next succeeding minimum weight and a subfield having the third succeeding minimum weight.

The first diffusion unit may generate the video signal to display the gray scale level in the first gray scale group which is obtained by adding or subtracting the value corresponding to the gray scale to be displayed to or from the gray scale level in the second gray scale group when the converted gray scale level from the gray scale conversion unit is in the second gray scale group.

The apparatus may further comprise a second diffusion unit for diffusing a difference between the gray scale level of pixel to be displayed and the converted gray scale level to pixels adjacent to the pixel to be displayed with predetermined ratio.

The second diffusion unit may determine a value to be diffused in horizontal direction based on a lower bits of all bits which indicate the gray scale level of pixel to be displayed, and a value to be diffused in vertical direction based on a value obtained by removing the lower bits from a difference between the gray scale level of the pixel to be displayed and the converted gray scale level.

A display method according to the invention performs gray scale display by dividing one field of picture into a plurality of weighted subfields and by controlling each subfield to emit or not emit based on the gray scale level of pixel in the picture. The method comprises selectively converting a gray scale level of the pixel to one gray scale level in a first gray scale group which includes a plurality of gray scale levels to be used for actual display, or to one gray scale level in a second gray scale group which includes a plurality of gray scale levels each of which has a value in the middle of the gray scale levels in the first gray scale group, and generating video signal. The gray scale level in the first gray scale group is expressed by the combination of the subfields. The video signal displays a gray scale level obtained by the conversion when the gray scale level obtained by the conversion is in the first gray scale group, while the video signal displays a gray scale level in the first gray scale group which is obtained by diffusing a predetermined value corresponding to the gray scale level in the second gray scale group when the gray scale level obtained by the conversion is in the second gray scale group.

Other objects and attainments together with a fuller understanding of the invention will become apparent and appreciated by referring to the following description and claims taken in conjunction with the accompanying drawings.

It should be noted that this application is based on the application No. 11-14446 filed in Japan.

BEST MODE FOR CARRYING OUT THE INVENTION

A preferred embodiment of a display apparatus according to the present invention is described below with reference to the accompanying figures. It is to be noted that for simplicity the following description is limited to operation with one color only, and it will be obvious to those who skilled in the art that the same method is applicable to a color display with each of the colors, that is, R(red), G(green) and B(blue).

Figure 1:
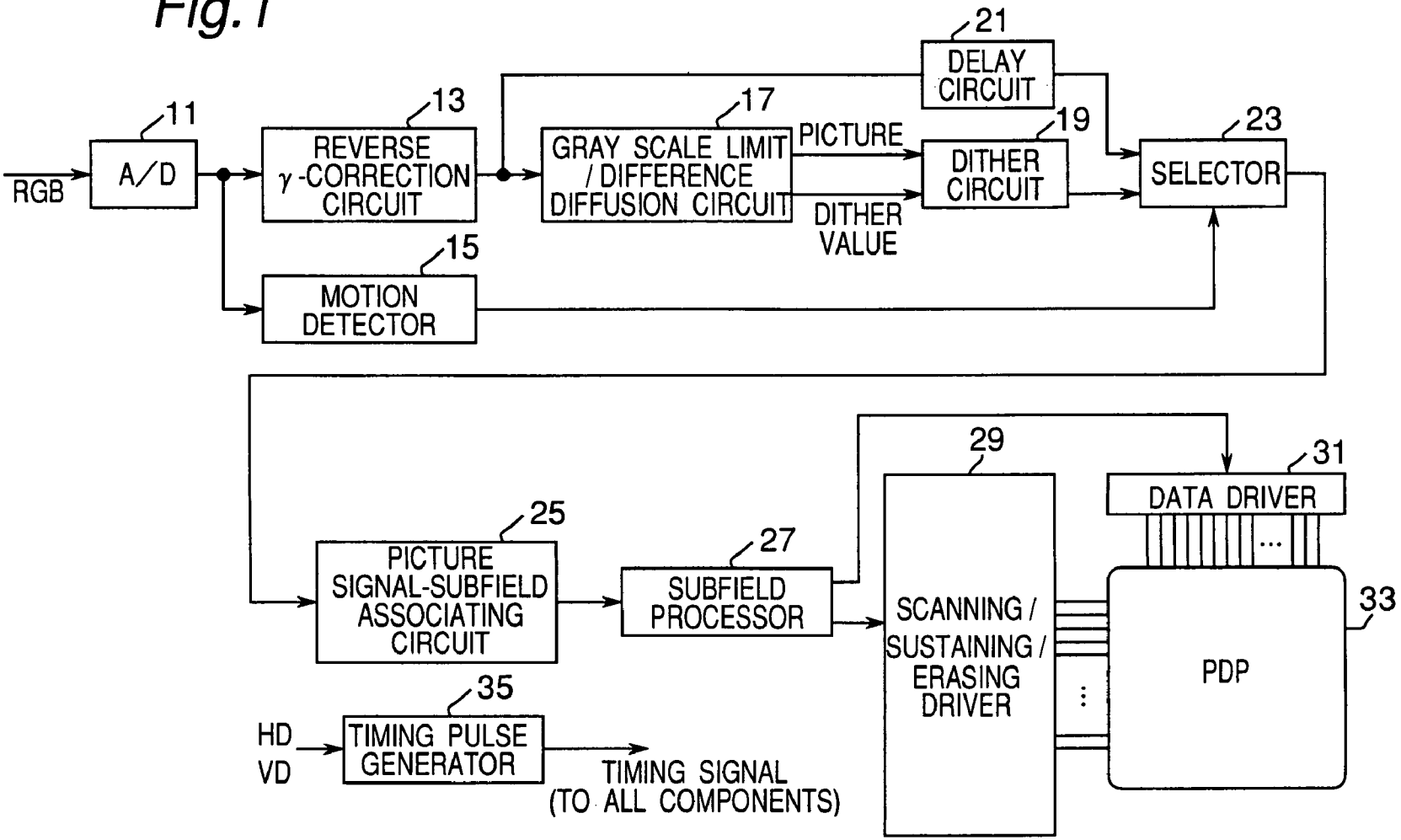
FIG. 1 is a typical block diagram of a display apparatus according to a preferred embodiment of the present invention.

An exemplary display apparatus according to the present invention is shown in FIG. 1. As shown in the figure, this display apparatus comprises an A/D converter 11, a reverse gamma correction circuit 13, a motion detector 15, a gray scale limiting and difference diffusion circuit 17, a dither circuit 19, delay circuit 21, selector 23, image signal-subfield associating circuit 25, subfield processor 27, scanning/sustaining/erasing driver 29, data driver 31, a plasma display panel (PDP) 33, and timing pulse generator 35.

The PDP 33 comprises a plurality of electrodes in a matrix pattern, and can be driven to present two values, that is, on or off. As described above, a multilevel gray scale display is achieved with this PDP 33 by using a plurality of weighted subfields. The timing pulse generator 35 generates a timing signal based on the horizontal hold signal HD and vertical hold signal VD, and supplies this timing signal (operation clock) to other parts of the display apparatus.

The A/D converter 11 A/D converts a supplied RGB signal. The converted digital RGB signal is then inverse gamma corrected by the reverse gamma correction circuit 13. More specifically, the supplied RGB signal has typically gamma characteristic suitable for presentation on a CRT display. Therefore the reverse gamma correction restores the original gamma characteristic of the uncorrected RGB signal. The A/D-converted RGB signal is then input to the motion detector 15 for moving picture detection. The result of image motion detection is then passed to the selector 23.

After reverse gamma correction, the RGB signal is sent to the delay circuit 21 and to the gray scale limiting and difference diffusion circuit 17. The gray scale limiting and difference diffusion circuit 17 and the dither circuit 19 apply a particular process for suppressing the occurrence of pseudo contours in moving picture elements. More specifically, the gray scale limiting and difference diffusion circuit 17 and dither circuit 19 convert the gray scale levels of pixels in moving picture areas of the supplied image signal that tend to produce pseudo contours to gray scale levels that are unlikely to produce pseudo contours. These circuits are further described more specifically below. The delay circuit 21 delays the reverse gamma corrected RGB signal by enough time required for processing in the circuits 17 and 19.

The selector 23 selects output from the dither circuit 19 based on the detection result of the motion detector 15 when the motion detector 15 detects motion picture. The selector 23 selects output from the delay circuit 21 when motion picture is not detected. This is because pseudo contours are observed only in moving pictures, and the process for suppressing pseudo contours in the picture signal is applied only to moving pictures.

The video signal selected by the selector 23 is sent to the picture signal-subfield associating circuit 25. This associating circuit 25 converts the video signal to field information comprising a plurality of bits corresponding to subfields. More specifically, this field information is an array of bits indicative of whether a corresponding subfield emits (is on) or not. The subfield processor 27 determines the number of sustain pulses output during the sustain period T3 based on the field information from the associating circuit 25. The scanning/sustaining/erasing driver 29 and data driver 31 control the electrodes of the PDP 33 based on output from the subfield processor 27 to control the on time of each pixel in order to display an image with the desired gray scale levels on PDP 33.

The gray scale limiting and difference diffusion circuit 17 and dither circuit 19 together perform a specific process for suppressing occurrence of pseudo contours in moving pictures of a supplied video signal. This specific process is further described below.

It is to be noted that one field is divided into nine subfields in this preferred embodiment of the present invention. These nine subfields 1 to 9 are respectively weighted with a luminance value of 1, 2, 4, 8, 16, 32, 48, 64 and 80. The weight of each subfield corresponds to the amount of light emitted (luminance) when that subfield is on. A desired gray scale level can be achieved by selecting an appropriate combination of subfields.

In general, pseudo contours possibly occur at adjacent pixels in moving pictures in the following case. Adjacent pixels emit at approximately equal luminance levels. Further, in a subfield having the greatest weight among the emitting subfields and emitting subfields having weights less than the greatest weight, the distribution of emitting and non-emitting subfields based on the weight is substantially equally separated, and the distribution is substantially opposite in adjacent pixels. For example, using the above-noted subfields 1 to 9 with weights of 1, 2, 4, 8, 16, 32, 48, 64 and 80, pseudo contours occur in such cases as when the luminance of adjacent pixels is 63 (=01 11111) and 64 (=10 10000), or 111(=011 11111) and 112 (=101 10000), for example. When such pixels are adjacent, movement in the sight line easily produces a great change in the distribution of the weights between emitting and non-emitting subfields even though there is only a slight change in gray scale, and a pseudo contour easily becomes apparent in the moving picture.

A display apparatus according to the present invention therefore does not use gray scale levels whereby pseudo contours can easily occur for display. Instead, the display apparatus selects only a number of gray scale levels by which pseudo contours is hardly appeared, and uses them for actual display. The gray scale levels thus selected and used for display is hereafter referred to as "display-use gray scale". The gray scale levels of the display-use gray scale compose a display-use gray scale group. The following gray scale levels are selected as the display-use gray scale levels thereby pseudo contours can be prevented and suppressed.

(a) Gradation level that is achieved by using a plurality of emitting subfields having the emitting subfield with the greatest weight among the emitting subfields required to achieve the desired gray scale level, and all emitting subfields having a weight less than the greatest weight.

In this case there are no non-emitting subfields from the subfield with the lowest weight to the subfield with the highest weight needed to achieve the desired gray scale level. That is, all subfields between these lowest and highest weight subfields emit. Pseudo contours can be suppressed at these gray scale levels because the number of emitting subfields increases stepwise as the gray scale level rises. When there are adjacent pixels with adjacent gray scale levels, there is no great change in the distribution of emitting and non-emitting subfields for the weights, and pseudo contours can therefore be suppressed in moving pictures. Gradation levels satisfying condition (a) are shown in Tables 1 to 5. It is to be noted that in the accompanying tables a value of 1 in the subfield columns indicates that the subfield emits. These gray scales are further indicated by a solid dot (•) in the "display-use gray scale" column. More specifically, gray scale levels of 1, 3, 7, 15, 31, 63, 111, 175, and 255 are these gray scale levels. In addition, gray scale level of 0 is added to the gray scale levels used for display. For example, referring to gray scale level of 31 in Table 1, the emitting subfield with the greatest weight required to display gray scale level of 31 is subfield 5, subfields 1 to 4 are all of the subfields with weight less than subfield 5, and all of these subfields also emit. As a result, gray scale level of 31 satisfies condition of (a).

In addition to the gray scale levels of condition (a), gray scale levels achieved by a plurality of emitting subfields including a greatest-weight subfield and a predetermined number of non-emitting subfields with less weight than the greatest-weight can also be taken as gray scale levels resistant to pseudo contours. That is, conditions (b) and (c) may be considered as follows.

(b) Gradation levels having one or less of non-emitting subfield in the emitting subfield with the greatest weight required to achieve the gray scale level and all subfields with weights less than the greatest weight.

(c) Gradation levels having two or less of non-emitting subfields in the emitting subfield with the greatest weight required to achieve the gray scale level and all subfields with weights less than the greatest weight.

The number of gray scale levels satisfying conditions (b) and (c) is more than that for condition (a). Therefore more number of gray scale levels can be displayed. There is not a great change between adjacent pixels in the distribution of emitting and non-emitting subfields with gray scale of (b) and (c), as well as gray scale of (a). Examples of gray scale of (b) are shown in Tables 6 to 10, and are similarly indicated by a solid dot (•) in the "display-use gray scale" column. More specifically, in addition to the gray scale levels of (a) shown in Tables 1 to 5, gray scale levels of (b) include levels of 2, 5, 6, 11, 13, 14, 251, 253, 254 and others.

For example, referring to gray scale level 14 in Table 6, the subfield with the greatest weight required to achieve gray scale level 14 is subfield 4; subfields 1 to 3 are all of the subfields with weight less than subfield 4, and these include only one non-emitting subfield (subfield 1). As a result, gray scale level of 14 satisfies condition (b) above.

A gray scale level exemplary of condition (c) above is gray scale level of 28. That is, the subfield with the greatest weight required to achieve gray scale level of 28 is subfield 5; subfields 1 to 4 are all of the subfields with weight less than subfield 4, and these include only two non-emitting subfields (subfield 1 and subfield 2). As a result, gray scale level of 28 satisfies condition (c) above.

By thus using for display only the gray scale levels selected above, higher order subfields and lower order subfields do not switch between emitting and non-emitting states at adjacent pixels and the occurrence of pseudo contours in moving pictures can be suppressed.

In cases (a) and (c) above, it may not be necessary to consider a specific lower order subfield. Because low order subfields have little weight, and therefore have relatively little effect on pseudo contours in moving pictures. For example, it is possible to select as gray scale levels of (a), levels for which all but the lowest order subfield (subfield 1) emit. It is alternatively possible to further exclude the second (subfield 2) from lowest order subfield 1, or the third (subfield 3) from lowest order subfield 1.

Gray scale levels each of which is in the middle of the display-use gray scale levels is further defined as "dithered gray scale "in this preferred embodiment of the present invention. Gray scale levels of the dithered gray scale compose a dithered gray scale group. These gray scales are indicated by a solid dot (•) in the "dithered gray scale" column in Tables 1 to 10.

For example, the dithered gray scale in Tables 1 to 5 are levels of 2, 5, 11, 23, 47, 87, 143, and 215. The distance between a dithered gray scale level and the adjacent display-use gray scale level is the dither value. For example, the dither value at dithered gray scale level of 11 in Table 1 is 4; at dithered gray scale level of 23, this value is 8. This dither value is not used directly for display purposes, but is used to express a dithered gray scale level by diffusing the dithered gray scale to the display-use gray scale levels above and below the dithered gray scale level based on the dither value.

A display apparatus according to the present invention is further described using the display-use gray scales and dithered gray scales shown in Tables 1 to 5. The display apparatus therefore displays at the luminance of gray scale levels of 0, 1, 3, 7, 15, 31, 63, 111, 175, and 255 only. Note, further, that dithered gray scale and display-use gray scale are both referred to as "converted gray scale."

The gray scale limiting and difference diffusion circuit 17 stores converted gray scale information in a gray scale table (described below). Using this gray scale table, the gray scale limiting and difference diffusion circuit 17 converts gray scale level of the pixel of the video signal after reverse gamma correction to a converted gray scale level. When the converted gray scale from the gray scale limiting and difference diffusion circuit 17 is one of display-use gray scale, the dither circuit 19 generates a video signal for presenting that display-use gray scale. When the converted gray scale level is one of dithered gray scale levels, the dither circuit 19 applies a predetermined diffusion process (described below) based on the dither value of that dithered gray scale, and generates a video signal for displaying the dithered gray scale using the display-use gray scale.

Figure 2A:
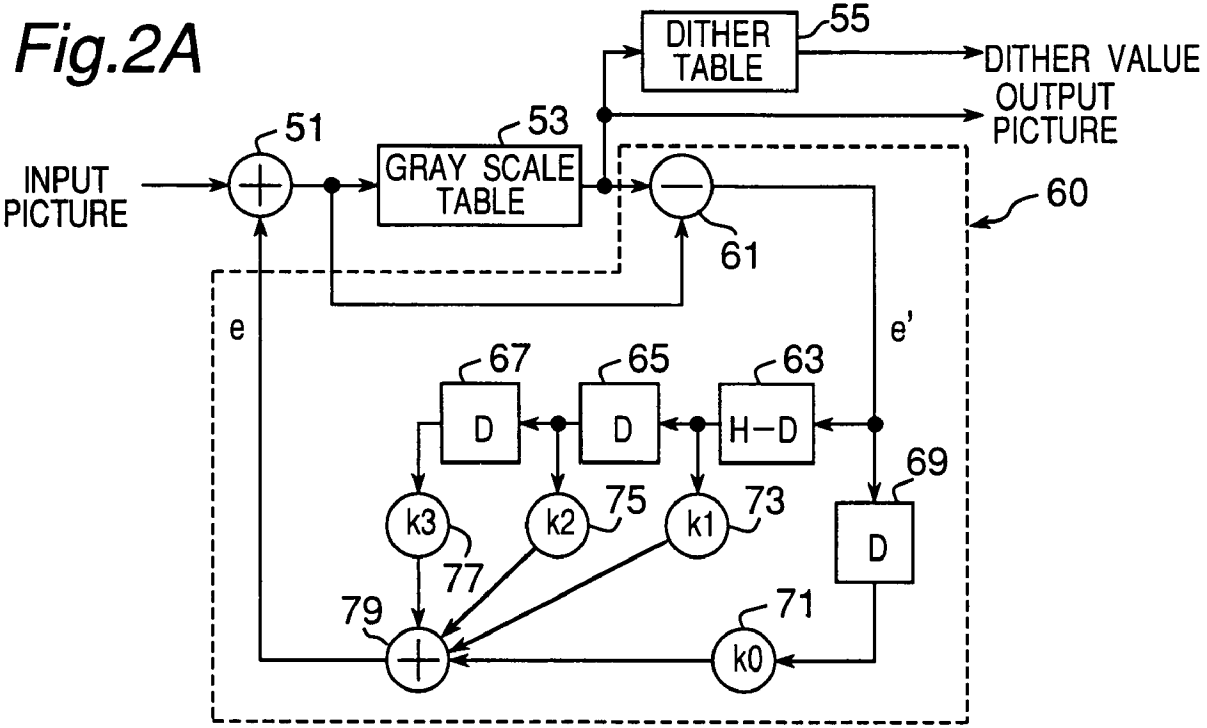
FIG. 2A is a typical block diagram of a gray scale limiting and difference diffusion circuit in the display apparatus shown in FIG. 1.

A typical configuration of an exemplary gray scale limiting and difference diffusion circuit 17 is shown in FIG. 2A. This gray scale limiting and difference diffusion circuit 17 comprises an adder 51, gray scale table 53, dither table 55, and difference diffusion processor 60. The operation of a gray scale limiting and difference diffusion circuit 17 thus comprised is described next below.

When a video signal containing pixel gray scale information is sent from the reverse gamma correction circuit 13 to gray scale limiting and difference diffusion circuit 17, adder 51 adds the original pixel gray scale based on the video signal and a difference e diffused from the pixels processed before that pixel, and outputs the result of the addition to the gray scale table 53 and difference diffusion processor 60.

The gray scale table 53 stores information relating to the above-noted converted gray scale levels, and converts a supplied gray scale level to a corresponding converted gray scale level. That is, the gray scale table 53 selects one converted gray scale level corresponding to the gray scale level determined by adding diffusion difference e to the original pixel gray scale, and outputs the selected converted gray scale level to the difference diffusion processor 60.

This gray scale table 53 contains in this exemplary embodiment the information relating to the display-use gray scales and dithered gray scales shown in Tables 1 to 5. Selected as output from gray scale 53 is the greater one of the highest converted gray scale within the gray scale range of the supplied signal and the dithered gray scale within the gray scale range of the supplied signal. For example, when the supplied gray scale level is 20, display-use gray scale level of 15 is selected. When the supplied gray scale level is 25, dithered gray scale level of 23 is selected.

The difference diffusion processor 60 performs a process for diffusing the difference between the converted gray scales obtained by gray scale table 53 and the gray scale level before conversion, to the pixels surrounding the pixel being processed. This is referred to below as a difference diffusion process. By applying this difference diffusion process to the entire image, the overall gray scale range of the screen image will be maintained, and the overall image will appear to the eye to be displayed with greater fidelity to the original luminance values of the individual pixels. It is therefore possible to display a clearer, sharper, higher quality image.

The difference diffusion processor 60 comprises subtracter 61, delay circuits 63, 65, 67 and 69, multipliers 71, 73, 75 and 77, and adder 79.

In the difference diffusion processor 60, by subtracter 61, the gray scale level obtained by adding difference e to the original pixel gray scale level is subtracted by the converted gray scale level from the gray scale level to obtain the difference e'. The obtained difference e' is passed to delay circuits 63 and 69.

Delay circuit 63 delays the input signal by a period equal to one line minus one pixel and output the delayed signal. Delay circuits 65, 67 and 69 delay the respective input signals by one pixel and output the delayed signal. Delay circuit 63 therefore outputs difference e' for the pixel immediately following the pixel currently being processed but in the preceding line. Delay circuit 65 outputs difference e' for the pixel currently being processed but in the preceding line. Delay circuit 67 outputs difference e' for the pixel immediately before the pixel currently being processed but in the preceding line. Delay circuit 69 outputs difference e' for the pixel immediately before the pixel currently being processed.

Figure 2C:
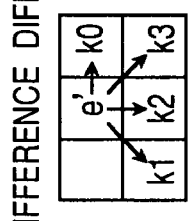
FIG. 2C illustrates the difference diffusion.
Figure 2B:
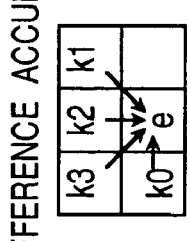
FIG. 2B illustrates the difference accumulation.

The difference values output from delay circuits 69, 63, 65 and 67 are then multiplied by predetermined coefficients k0, k1, k2, and k3 by multipliers 71, 73, 75 and 77. The coefficients k0, k1, k2, and k3 are desirably set so that k0+k1+k2+k3=1. Adder 79 then adds the outputs from multipliers 71, 73, 75, and 77, and outputs the sum as the difference e for the pixel being processed. In other words, difference diffusion processor 60 diffuses the difference e' between the converted gray scale level and the gray scale level obtained by adding difference e to the original pixel gray scale level, to adjacent pixels at a specific diffusion ratio k0 to k3 as shown in FIG. 2C. In addition, the diffusion difference e for a certain pixel is obtained by adding the difference diffused from adjacent pixels as shown in FIG. 2B.

The converted gray scale level obtained by gray scale table 53 is also output to dither table 55. This dither table 55 has information correlating the dithered gray scale levels and dither values shown in Tables 1 to 5. The dither table 55 thus outputs the dither value corresponding to a particular dithered gray scale level when the converted gray scale level supplied from the gray scale table 53 is a dithered gray scale; when not a dithered gray scale, that is, is a display-use gray scale, the dither table 55 outputs a dither value of 0. For example, when the converted gray scale level supplied from the gray scale table 53 is 23, the dither table 55 outputs a dither value of 8 (see Table 1).

When receiving the gray scale level for a particular pixel, the gray scale limiting and difference diffusion circuit 17 thus selects a converted gray scale level appropriate for expressing the gray scale level of the pixel based on a gray scale level obtained by adding a diffusion difference value for that pixel to the gray scale level of the pixel. The gray scale limiting and difference diffusion circuit 17 then outputs a dither value for that converted gray scale level. The dither values and video signal containing converted gray scale levels are then output from the gray scale limiting and difference diffusion circuit 17 to the dither circuit 19.

Next, this dither circuit 19 is described. The dither circuit 19 performs a diffusing process (dither diffusing process) when the converted gray scale level obtained by the gray scale limiting and difference diffusion circuit 17 is not a display-use gray scale, that is, is a dithered gray scale. This diffusing process diffuses a gray scale level in the dithered gray scale by dither value to obtain a gray scale level in the display-use gray scale to be displayed.

More specifically, when the input gray scale level is the dithered gray scale, the dither circuit 19 generates a video signal in which the display-use gray scale levels offset the dither value from the dithered gray scale level are alternately displayed in even and odd fields of one picture field. The desired dithered gray scale level is thus achieved on screen by time-averaging the display of appropriately selected display-use gray scales levels. For example, to display gray scale level of 23 which is a dithered gray scale with a dither value of 8, one of even and odd field is displayed at gray scale level of 15 (=23−8), and the other of even and odd field is displayed at gray scale level of 31 (= 23+8).

Figures 3A, 3B, 3C, 3D, 3E, 3F, 3G:
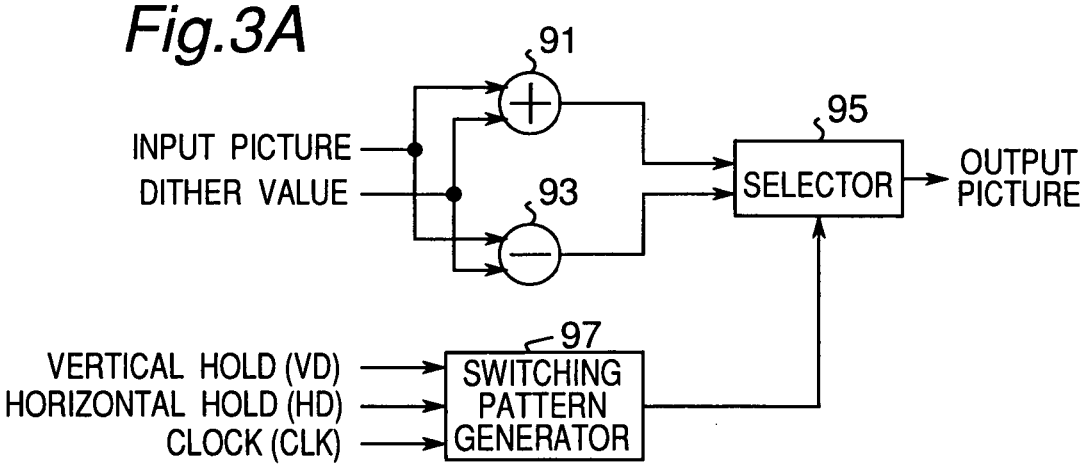
FIG. 3A is a typical block diagram of a dither circuit in the display apparatus shown in FIG. 1.
FIGS. 3B–3C, 3D–3E, and 3F–3G illustrates diffusion pattern for even and odd fields in the display apparatus shown in FIG. 1.

Dithering (gray scale diffusion) is changed pixel by pixel as shown in FIGS. 3B and 3C in this diffusing process. That is, whether dither values are added to or subtracted from a adjacent pixel depends on whether an odd or even field is being processed with the dither patterns of the odd and even fields being mutually opposite. Adding and subtracting dither values are also opposite at the same pixel position in even and odd fields. Adding and subtracting dither values can also be inverted in this diffusing process by line as shown in FIGS. 3D and 3E, or by field as shown in FIGS. 3F and 3G. It is to be noted that in each case, that is, FIGS. 3B and 3C, FIGS. 3D and 3E, and FIGS. 3F and 3G, dithering results in a zero sum in corresponding even and odd fields.

Using dithered gray scale in addition to the above-noted display-use gray scales as converted gray scales can be expected to yield the following benefits.

Figure 4:
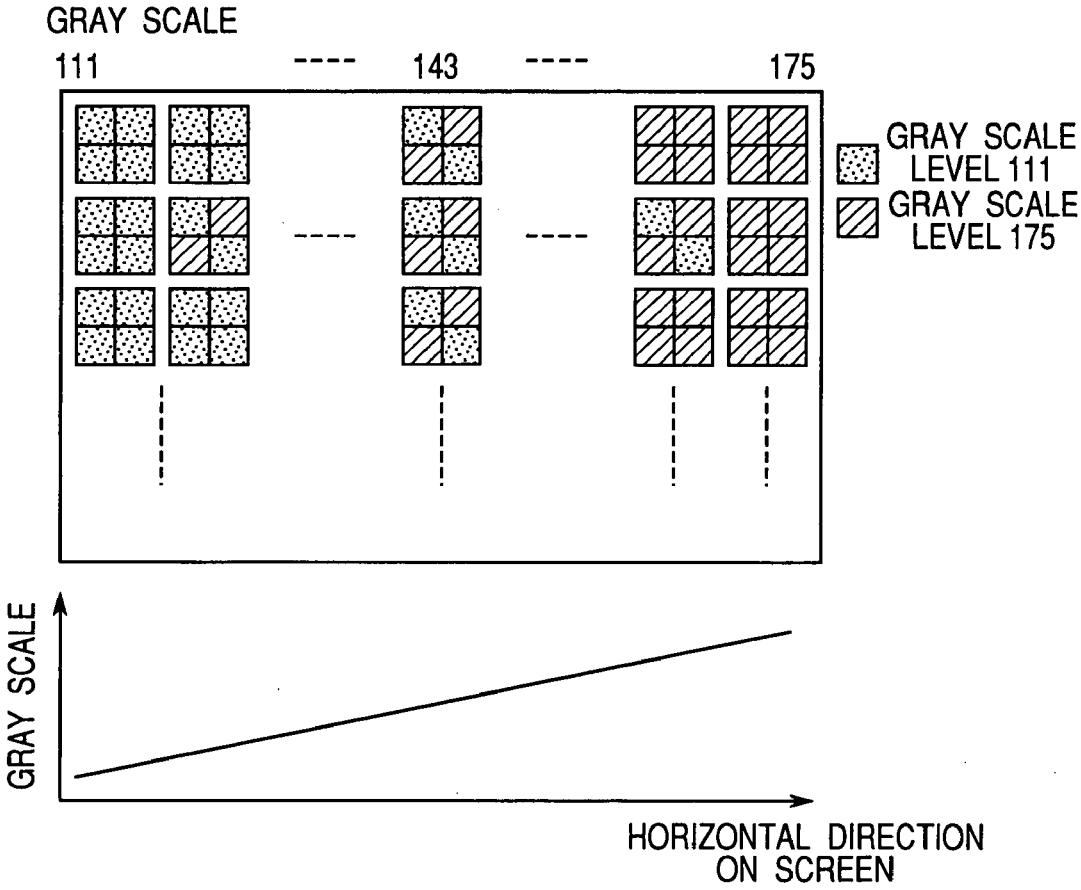
FIG. 4 illustrates the change in pixel gray scale displayed on screen by a display apparatus according to the present invention.

Let us assume that the gray scale level changes from 111 to 175 from the left to right sides of the screen as shown in FIG. 4. Only gray scale level of 111 appears at the left edge of the screen, and only gray scale level of 175 is at the right edge. A gray scale level of 143 (dithered gray scale) is in the middle, where gray scale levels of 111 and 175 can be alternately switched to be displayed equally. The ratio at which levels of 111 and 175 appear from the middle of the screen to both edges changes continuously. In other words, when a dithered gray scale (which is level of 143 in this example) which in the middle of display-use gray scale levels is achieved, the display-use gray scales appears precisely half of the total presentation time. It is therefore possible to display the middle gray scale more clearly compared with using only difference diffusion and no dithered gray scales.

The configuration of a typical dither circuit 19 is shown in FIG. 3A. The dither circuit 19 comprises an adder 91, subtracter 93, selector 95, and switching pattern generator 97.

The adder 91 adds the dither value to a converted gray scale. The subtracter 93 subtracts the dither value from the converted gray scale. The switching pattern generator 97 outputs a control signal determining whether the dither value is added or subtracted for a given pixel based on the pattern shown in FIG. 3B or 3C. The selector 95 selects the output from the adder 91 or subtracter 93 based on the control signal to pass.

When the converted gray scale output from the gray scale limiting and difference diffusion circuit 17 is a display-use gray scale, the dither value is output as 0. The dither circuit 19 therefore has no effect on gray scale whether it adds or subtracts.

A display apparatus according to this preferred embodiment of the present invention thus converts the original gray scale level of each pixel to a display-use gray scale that is relatively resistant to pseudo contours appearing in moving pictures. By using only these selected display gray scales to achieve a multilevel gray scale display, the occurrence of pseudo contours in moving pictures can thus be suppressed.

As described above, however, the gray scale limiting and difference diffusion circuit 17 sequentially receives the video signal for each pixel and processes pixels one by one in synchronous with a predetermined operating clock. The operating clock is typically set to the time required to process one pixel. With a screen contains 852×480 pixels, for example, one clock of the operating clock runs at approximately 40.7 ns, that is, 1 second/60 frames/(852×480 pixels). Processing one pixel must be completed by the time the next pixel is received. For example, the gray scale difference to be diffused for the next pixel must be calculated within a period of one clock cycle. This means that the gray scale table 53 of the gray scale limiting and difference diffusion circuit 17 must convert the gray scale of the pixel being processed to the particular converted gray scale, and the difference diffusion processor 60 must complete the diffusing operation, within one clock cycle.

Processing by the gray scale table 53 and the subtracter 61 of the difference diffusion processor 60 alone, however, requires approximately 34.5 μs, an extremely long time relative to the clock cycle. Particularly the operation in the subtracter 61 takes much time. To complete these operations within one clock cycle using the circuit design shown in FIG. 2A, it is therefore necessary to generate and supply to the difference diffusion processor 60 a high speed clock that is provided extra. This necessitates complex circuitry, increases the overall circuit scale, and leads to increased cost. A preferred embodiment of the gray scale limiting and difference diffusion circuit 17 that solves this problem is described below.

Figure 5A:
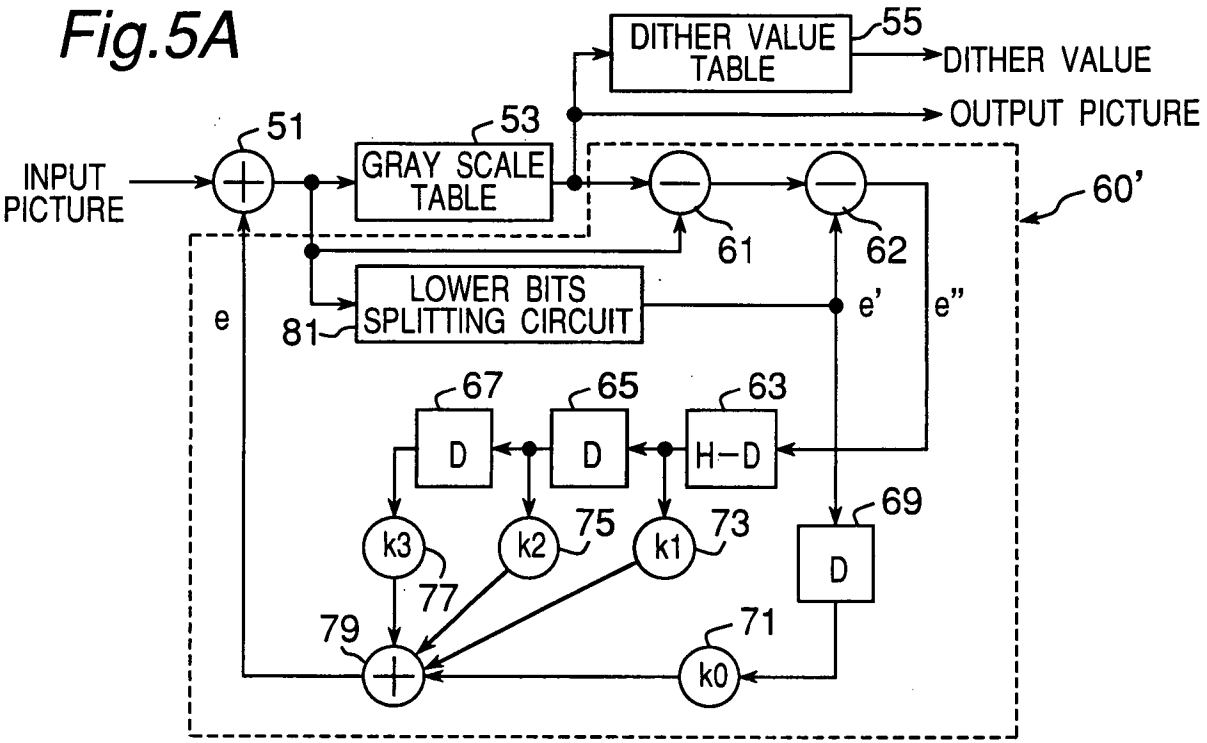
FIG. 5A is a typical block diagram of another limit/difference diffusion circuit.
Figure 5B:
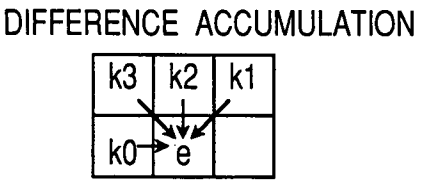
FIG. 5B illustrates the difference accumulation.
Figure 5C:
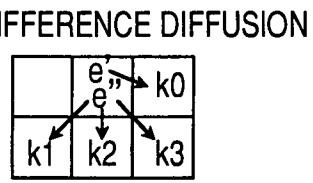
FIG. 5C illustrates the difference diffusion.
Figure 6:
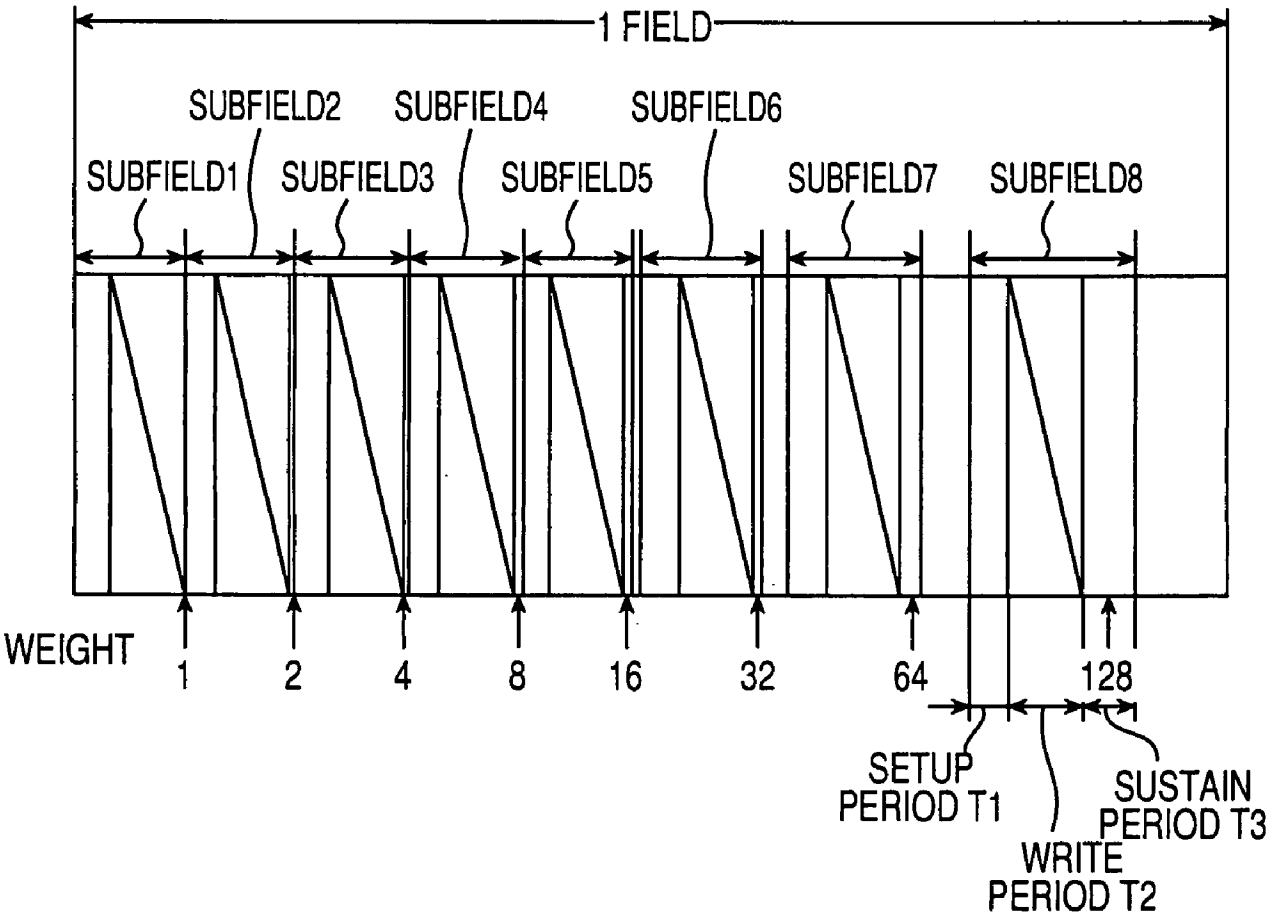
Fig.6 PRIOR ART
FIG. 6 illustrates subfield division of a single image field in a so-called subfield method.
Figure 7:
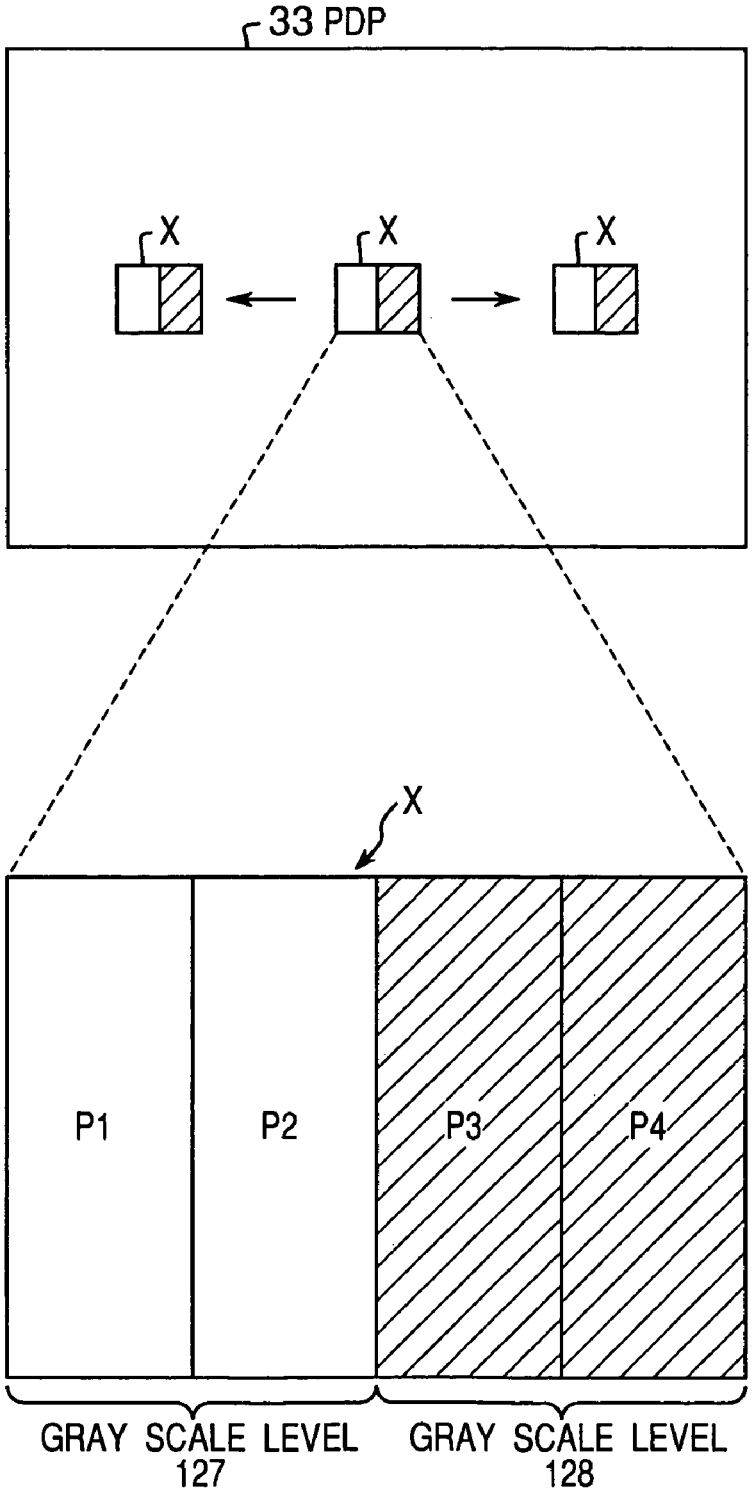
Fig.7 PRIOR ART
FIG. 7 illustrates the occurrence of pseudo contours in moving pictures.
Figure 8:
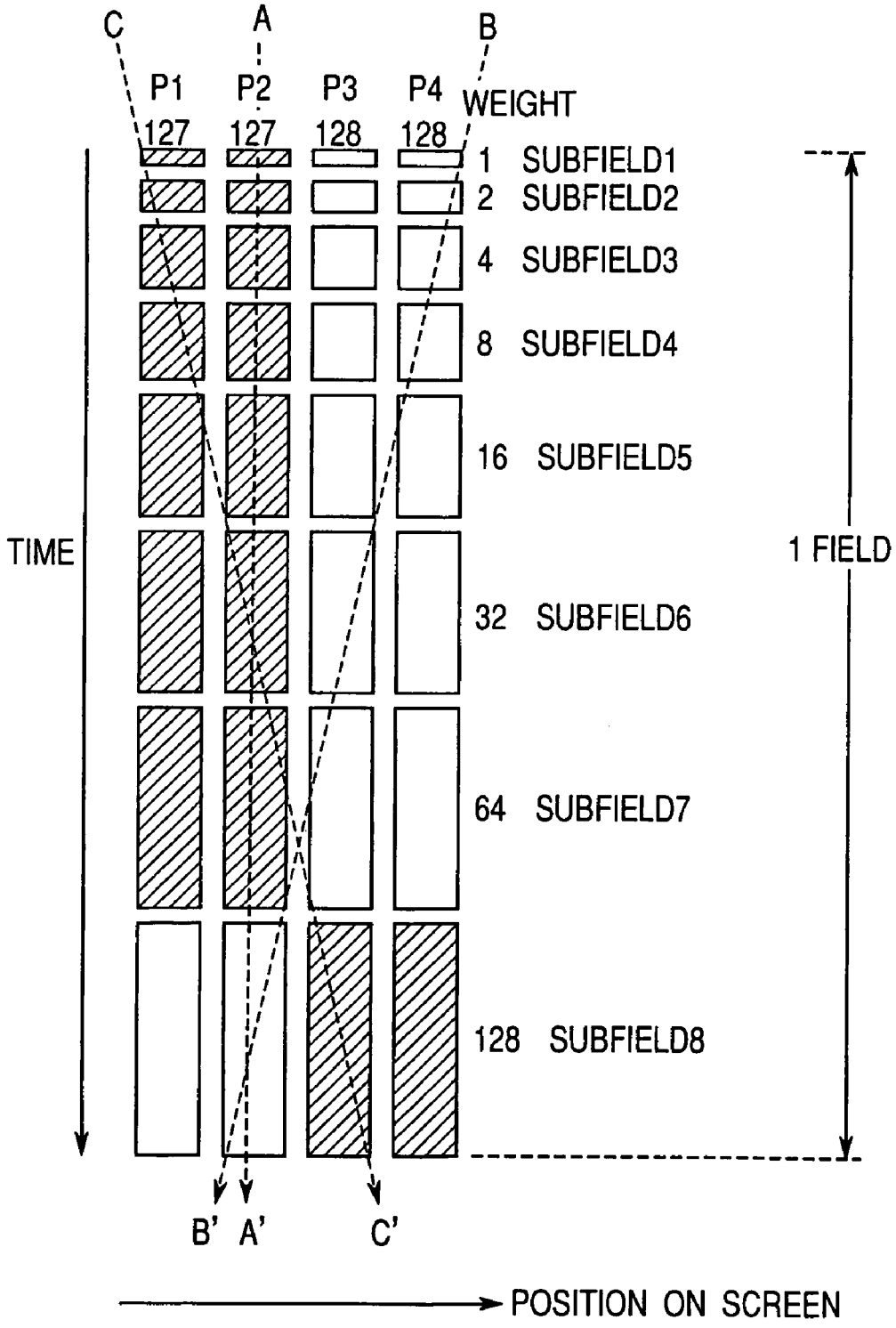
Fig.8 PRIOR ART
FIG. 8 illustrates a cause for the occurrence of pseudo contours in moving pictures.

FIG. 5A shows the preferred structure of the gray scale limiting and difference diffusion circuit 17. It is to be noted that like parts in FIG. 2A and FIG. 5A are identified by like reference numeral. The gray scale limiting and difference diffusion circuit 17 shown in FIG. 5A differs from that shown in FIG. 2A in the design of the difference diffusion processor 60'.

The time required for diffusing to the next pixel, that is, in the horizontal direction, is particularly short. The purpose of this difference diffusion processor 60', therefore, is to accelerate diffusing operation calculations in the horizontal direction.

In addition to the parts shown in FIG. 2A, the difference diffusion processor 60' in FIG. 5A further comprises a low bits splitting circuit 81 and another subtracter 62. The low bits splitting circuit 81 receives output from the adder 51. The delay circuit 69 receives output e' from the low bits splitting circuit 81. The subtracter 62 is disposed between the subtracter 61 and the delay circuit 63 to receive output from subtracter 61 and output e' from low bits splitting circuit 81.

A difference diffusion processor 60' thus comprised uses a predetermined low bits in the gray scale data from the adder 51 as the difference e' to be diffused to the next pixel to be processed, that is, the pixel immediately following the pixel currently being processed. More specifically, the low bits splitting circuit 81 separates the lower 4 bits from the gray scale data (which is normally 8 bits) received from adder 51 as difference e'. The low bits splitting circuit 81 can easily separate predetermined low bits from the supplied data with processing being completed in an extremely short time. Processing can therefore be easily completed within one clock cycle.

The difference e" to be diffused in the vertical direction, that is, to the same pixel in the next line, can be obtained by the subtracter 61 obtaining the difference between the gray scale level obtained by adding difference e to the original pixel gray scale level and the converted gray scale level obtained from gray scale table 53, and subtracter 62 removing from this difference the difference e' already diffused in the horizontal direction. There is no problems to obtain the difference e" to be diffused in the vertical direction by operating (subtracting) the gray scale, because there is a time margin or delay of approximately one line until the diffusion value is used.

This difference diffusion processor 60' thus takes lower bits obtained from the gray scale data (typically 8 bits) as the difference to be diffused to the next pixel in the horizontal direction. The difference diffusion processor 60' also takes, as the diffused difference in vertical direction, value obtained by subtracting the horizontal diffusion value from the difference between the original pixel gray scale level including difference e and the gray scale level obtained from gray scale table 53. The processor 60' performs difference diffusion process using those difference values. It is therefore possible using a simple circuit design to complete the diffusing operation in a short time within one clock cycle.

As will be known from the preceding description of preferred embodiments of the present invention, a display apparatus according to the present invention uses only specific gray scale levels selected from among the range of gray scale levels that can be expressed by the above-described subfield method. These specific gray scale levels are gray scales at which pseudo contours in moving pictures do not easily occur. More specifically, these gray scale levels include gray scale levels of (a) achieved using a plurality of emitting subfields including the emitting subfield with the greatest weight required to achieve the gray scale level and all subfields with a weight less than this greatest weight, and gray scale levels of (b) achieved using a plurality of emitting subfields including the emitting subfield with the greatest weight required to achieve the gray scale level and at most one non-emitting subfield with less weight than the greatest-weight.

In other words, a display apparatus according to the present invention uses for video display only gray scale levels that are unlikely to produce undesirable pseudo contours in moving pictures. As a result, the occurrence of such pseudo contours can be suppressed. When converting the original gray scale level of each pixel in the picture to one of these gray scale levels used for display, a display apparatus according to the present invention preferably converts to one of these display gray scale levels or to an intermediate gray scale level between gray scale levels. By thus including such intermediate gray scale levels in the gray scale conversion process, smoother transitions between gray scale levels can be achieved.

It is further preferable to diffuse to surrounding pixels any difference that occurs in the conversion of the original pixel gray scale levels to a selected display-use gray scale level. This operation retains the original pixel gray scale level within the overall image.

The diffusion or dither value applied in the horizontal direction can also be obtained by simply detecting specific low bits in the pixel gray scale data. The time required to obtain this diffusion information can thus be shortened, and a simple circuit configuration can be used for the dithering operation.

Although the present invention has been described in connection with specified embodiments thereof, many other modifications, corrections and applications are apparent to those skilled in the art. Therefore, the present invention is not limited by the disclosure provided herein but limited only to the scope of the appended claims.

TABLE I

Example of Gray Scale Display with 9 Subfields
(Display-use Gray Scale in which all subfields
lighter than the emittig heaviest subfield are emitted)

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 0 | | | | | | | | | | ● | | |
| 1 | 1 | | | | | | | | | ● | | |
| 2 | | 1 | | | | | | | | | ● | 1 |
| 3 | 1 | 1 | | | | | | | | ● | | |
| 4 | | | 1 | | | | | | | | | |
| 5 | 1 | | 1 | | | | | | | | ● | 2 |
| 6 | | 1 | 1 | | | | | | | | | |
| 7 | 1 | 1 | 1 | | | | | | | ● | | |
| 8 | | | | 1 | | | | | | | | |
| 9 | 1 | | | 1 | | | | | | | | |
| 10 | | 1 | | 1 | | | | | | | | |
| 11 | 1 | 1 | | 1 | | | | | | | ● | 4 |
| 12 | | | 1 | 1 | | | | | | | | |
| 13 | 1 | | 1 | 1 | | | | | | | | |
| 14 | | 1 | 1 | 1 | | | | | | | | |
| 15 | 1 | 1 | 1 | 1 | | | | | | ● | | |
| 16 | | | | | 1 | | | | | | | |
| 17 | 1 | | | | 1 | | | | | | | |
| 18 | | 1 | | | 1 | | | | | | | |
| 19 | 1 | 1 | | | 1 | | | | | | | |
| 20 | | | 1 | | 1 | | | | | | | |
| 21 | 1 | | 1 | | 1 | | | | | | | |
| 22 | | 1 | 1 | | 1 | | | | | | | |
| 23 | 1 | 1 | 1 | | 1 | | | | | | ● | 8 |
| 24 | | | | 1 | 1 | | | | | | | |
| 25 | 1 | | | 1 | 1 | | | | | | | |
| 26 | | 1 | | 1 | 1 | | | | | | | |
| 27 | 1 | 1 | | 1 | 1 | | | | | | | |
| 28 | | | 1 | 1 | 1 | | | | | | | |
| 29 | 1 | | 1 | 1 | 1 | | | | | | | |
| 30 | | 1 | 1 | 1 | 1 | | | | | | | |
| 31 | 1 | 1 | 1 | 1 | 1 | | | | | ● | | |
| 32 | | | | | | 1 | | | | | | |
| 33 | 1 | | | | | 1 | | | | | | |
| 34 | | 1 | | | | 1 | | | | | | |
| 35 | 1 | 1 | | | | 1 | | | | | | |
| 36 | | | 1 | | | 1 | | | | | | |
| 37 | 1 | | 1 | | | 1 | | | | | | |
| 38 | | 1 | 1 | | | 1 | | | | | | |
| 39 | 1 | 1 | 1 | | | 1 | | | | | | |
| 40 | | | | 1 | | 1 | | | | | | |
| 41 | 1 | | | 1 | | 1 | | | | | | |
| 42 | | 1 | | 1 | | 1 | | | | | | |
| 43 | 1 | 1 | | 1 | | 1 | | | | | | |
| 44 | | | 1 | 1 | | 1 | | | | | | |
| 45 | 1 | | 1 | 1 | | 1 | | | | | | |
| 46 | | 1 | 1 | 1 | | 1 | | | | | | |
| 47 | 1 | 1 | 1 | 1 | | 1 | | | | | ● | 16 |
| 48 | | | | | 1 | 1 | | | | | | |

TABLE 2

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 49 | 1 | | | | 1 | 1 | | | | | | |
| 50 | | 1 | | | 1 | 1 | | | | | | |
| 51 | 1 | 1 | | | 1 | 1 | | | | | | |
| 52 | | | 1 | | 1 | 1 | | | | | | |
| 53 | 1 | | 1 | | 1 | 1 | | | | | | |
| 54 | | 1 | 1 | | 1 | 1 | | | | | | |

TABLE 2-continued

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 55 | 1 | 1 | 1 | | 1 | 1 | | | | | | |
| 56 | | | | 1 | 1 | 1 | | | | | | |
| 57 | 1 | | | 1 | 1 | 1 | | | | | | |
| 58 | | 1 | | 1 | 1 | 1 | | | | | | |
| 59 | 1 | 1 | | 1 | 1 | 1 | | | | | | |
| 60 | | | 1 | 1 | 1 | 1 | | | | | | |
| 61 | 1 | | 1 | 1 | 1 | 1 | | | | | | |
| 62 | | 1 | 1 | 1 | 1 | 1 | | | | | | |
| 63 | 1 | 1 | 1 | 1 | 1 | 1 | | | | ● | | |
| 64 | | | | | 1 | | 1 | | | | | |
| 65 | 1 | | | | 1 | | 1 | | | | | |
| 66 | | 1 | | | 1 | | 1 | | | | | |
| 67 | 1 | 1 | | | 1 | | 1 | | | | | |
| 68 | | | 1 | | 1 | | 1 | | | | | |
| 69 | 1 | | 1 | | 1 | | 1 | | | | | |
| 70 | | 1 | 1 | | 1 | | 1 | | | | | |
| 71 | 1 | 1 | 1 | | 1 | | 1 | | | | | |
| 72 | | | | 1 | 1 | | 1 | | | | | |
| 73 | 1 | | | 1 | 1 | | 1 | | | | | |
| 74 | | 1 | | 1 | 1 | | 1 | | | | | |
| 75 | 1 | 1 | | 1 | 1 | | 1 | | | | | |
| 76 | | | 1 | 1 | 1 | | 1 | | | | | |
| 77 | 1 | | 1 | 1 | 1 | | 1 | | | | | |
| 78 | | 1 | 1 | 1 | 1 | | 1 | | | | | |
| 79 | 1 | 1 | 1 | 1 | 1 | | 1 | | | | | |
| 80 | | | | | | 1 | 1 | | | | | |
| 81 | 1 | | | | | 1 | 1 | | | | | |
| 82 | | 1 | | | | 1 | 1 | | | | | |
| 83 | 1 | 1 | | | | 1 | 1 | | | | | |
| 84 | | | 1 | | | 1 | 1 | | | | | |
| 85 | 1 | | 1 | | | 1 | 1 | | | | | |
| 86 | | | | 1 | 1 | | 1 | | | | | |
| 87 | 1 | 1 | 1 | | | 1 | 1 | | | | ● | 24 |
| 88 | | | | 1 | | 1 | 1 | | | | | |
| 89 | 1 | | | 1 | | 1 | 1 | | | | | |
| 90 | | 1 | | 1 | | 1 | 1 | | | | | |
| 91 | 1 | 1 | | 1 | | 1 | 1 | | | | | |
| 92 | | | 1 | 1 | | 1 | 1 | | | | | |
| 93 | 1 | | 1 | 1 | | 1 | 1 | | | | | |
| 94 | 1 | | 1 | 1 | | 1 | 1 | | | | | |
| 95 | 1 | 1 | 1 | 1 | | 1 | 1 | | | | | |
| 96 | | | | | 1 | 1 | 1 | | | | | |
| 97 | 1 | | | | 1 | 1 | 1 | | | | | |
| 98 | | 1 | | | 1 | 1 | 1 | | | | | |
| 99 | 1 | 1 | | | 1 | 1 | 1 | | | | | |
| 100 | | | 1 | | 1 | 1 | 1 | | | | | |

TABLE 3

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 101 | 1 | | 1 | | 1 | 1 | 1 | | | | | |
| 102 | | 1 | 1 | | 1 | 1 | 1 | | | | | |
| 103 | 1 | 1 | 1 | | 1 | 1 | 1 | | | | | |
| 104 | | | | 1 | 1 | 1 | 1 | | | | | |
| 105 | 1 | | | 1 | 1 | 1 | 1 | | | | | |
| 106 | | 1 | | 1 | 1 | 1 | 1 | | | | | |
| 107 | 1 | 1 | | 1 | 1 | 1 | 1 | | | | | |
| 108 | | | 1 | 1 | 1 | 1 | 1 | | | | | |
| 109 | 1 | | 1 | 1 | 1 | 1 | 1 | | | | | |
| 110 | | 1 | 1 | 1 | 1 | 1 | 1 | | | | | |
| 111 | 1 | 1 | 1 | 1 | 1 | 1 | 1 | | | ● | | |
| 112 | | | | | 1 | 1 | | 1 | | | | |
| 113 | 1 | | | | 1 | 1 | | 1 | | | | |

TABLE 3-continued

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 114 | | 1 | | | 1 | 1 | | 1 | | | | |
| 115 | 1 | 1 | | | 1 | 1 | | 1 | | | | |
| 116 | | | 1 | | 1 | 1 | | 1 | | | | |
| 117 | 1 | | 1 | | 1 | 1 | | 1 | | | | |
| 118 | | 1 | 1 | | 1 | 1 | | 1 | | | | |
| 119 | 1 | 1 | 1 | | 1 | 1 | | 1 | | | | |
| 120 | | | | 1 | 1 | 1 | | 1 | | | | |
| 121 | 1 | | | 1 | 1 | 1 | | 1 | | | | |
| 122 | | 1 | | 1 | 1 | 1 | | 1 | | | | |
| 123 | 1 | 1 | | 1 | 1 | 1 | | 1 | | | | |
| 124 | | | 1 | 1 | 1 | 1 | | 1 | | | | |
| 125 | 1 | | 1 | 1 | 1 | 1 | | 1 | | | | |
| 126 | | 1 | 1 | 1 | 1 | 1 | | 1 | | | | |
| 127 | 1 | 1 | 1 | 1 | 1 | 1 | | 1 | | | | |
| 128 | | | | | 1 | | 1 | 1 | | | | |
| 129 | 1 | | | | 1 | | 1 | 1 | | | | |
| 130 | | 1 | | | 1 | | 1 | 1 | | | | |
| 131 | 1 | 1 | | | 1 | | 1 | 1 | | | | |
| 132 | | | 1 | | 1 | | 1 | 1 | | | | |
| 133 | 1 | | 1 | | 1 | | 1 | 1 | | | | |
| 134 | | 1 | 1 | | 1 | | 1 | 1 | | | | |
| 135 | 1 | 1 | 1 | | 1 | | 1 | 1 | | | | |
| 136 | | | | 1 | 1 | | 1 | 1 | | | | |
| 137 | 1 | | | 1 | 1 | | 1 | 1 | | | | |
| 138 | | 1 | | 1 | 1 | | 1 | 1 | | | | |
| 139 | 1 | 1 | | 1 | 1 | | 1 | 1 | | | | |
| 140 | | | 1 | 1 | 1 | | 1 | 1 | | | | |
| 141 | 1 | | 1 | 1 | 1 | | 1 | 1 | | | | |
| 142 | | 1 | 1 | 1 | 1 | | 1 | 1 | | | | |
| 143 | 1 | 1 | 1 | 1 | 1 | | 1 | 1 | | | ● | 32 |
| 144 | | | | | | 1 | 1 | 1 | | | | |
| 145 | 1 | | | | | 1 | 1 | 1 | | | | |
| 146 | | 1 | | | | 1 | 1 | 1 | | | | |
| 147 | 1 | 1 | | | | 1 | 1 | 1 | | | | |
| 148 | | | 1 | | | 1 | 1 | 1 | | | | |
| 149 | 1 | | 1 | | | 1 | 1 | 1 | | | | |
| 150 | | 1 | 1 | | | 1 | 1 | 1 | | | | |
| 151 | 1 | 1 | 1 | | | 1 | 1 | 1 | | | | |
| 152 | | | | 1 | | 1 | 1 | 1 | | | | |

TABLE 4

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 153 | 1 | | | 1 | | 1 | 1 | 1 | | | | |
| 154 | | 1 | | 1 | | 1 | 1 | 1 | | | | |
| 155 | 1 | 1 | | 1 | | 1 | 1 | 1 | | | | |
| 156 | | | 1 | 1 | | 1 | 1 | 1 | | | | |
| 157 | 1 | | 1 | 1 | | 1 | 1 | 1 | | | | |
| 158 | | 1 | 1 | 1 | | 1 | 1 | 1 | | | | |
| 159 | 1 | 1 | 1 | 1 | | 1 | 1 | 1 | | | | |
| 160 | | | | | 1 | 1 | 1 | 1 | | | | |
| 161 | 1 | | | | 1 | 1 | 1 | 1 | | | | |
| 162 | | 1 | | | 1 | 1 | 1 | 1 | | | | |
| 163 | 1 | 1 | | | 1 | 1 | 1 | 1 | | | | |
| 164 | | | 1 | | 1 | 1 | 1 | 1 | | | | |
| 165 | 1 | | 1 | | 1 | 1 | 1 | 1 | | | | |
| 166 | | 1 | 1 | | 1 | 1 | 1 | 1 | | | | |
| 167 | 1 | 1 | 1 | | 1 | 1 | 1 | 1 | | | | |
| 168 | | | | 1 | 1 | 1 | 1 | 1 | | | | |
| 169 | 1 | | | 1 | 1 | 1 | 1 | 1 | | | | |
| 170 | | 1 | | 1 | 1 | 1 | 1 | 1 | | | | |
| 171 | 1 | 1 | | 1 | 1 | 1 | 1 | 1 | | | | |
| 172 | | | 1 | 1 | 1 | 1 | 1 | 1 | | | | |

TABLE 4-continued

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 173 | 1 | | 1 | 1 | 1 | 1 | 1 | 1 | | | | |
| 174 | | 1 | 1 | 1 | 1 | 1 | 1 | 1 | | | | |
| 175 | 1 | 1 | 1 | 1 | 1 | 1 | 1 | 1 | | ● | | |
| 176 | | | | | 1 | 1 | 1 | | 1 | | | |
| 177 | 1 | | | | 1 | 1 | 1 | | 1 | | | |
| 178 | | 1 | | | 1 | 1 | 1 | | 1 | | | |
| 179 | 1 | 1 | | | 1 | 1 | 1 | | 1 | | | |
| 180 | | | 1 | | 1 | 1 | 1 | | 1 | | | |
| 181 | 1 | | 1 | | 1 | 1 | 1 | | 1 | | | |
| 182 | | 1 | 1 | | 1 | 1 | 1 | | 1 | | | |
| 183 | 1 | 1 | 1 | | 1 | 1 | 1 | | 1 | | | |
| 184 | | | | 1 | 1 | 1 | 1 | | 1 | | | |
| 185 | 1 | | | 1 | 1 | 1 | 1 | | 1 | | | |
| 186 | | 1 | | 1 | 1 | 1 | 1 | | 1 | | | |
| 187 | 1 | 1 | | 1 | 1 | 1 | 1 | | 1 | | | |
| 188 | | | 1 | 1 | 1 | 1 | 1 | | 1 | | | |
| 189 | 1 | | 1 | 1 | 1 | 1 | 1 | | 1 | | | |
| 190 | | 1 | 1 | 1 | 1 | 1 | 1 | | 1 | | | |
| 191 | 1 | 1 | 1 | 1 | 1 | 1 | 1 | | 1 | | | |
| 192 | | | | | 1 | 1 | | 1 | 1 | | | |
| 193 | 1 | | | | 1 | 1 | | 1 | 1 | | | |
| 194 | | 1 | | | 1 | 1 | | 1 | 1 | | | |
| 195 | 1 | 1 | | | 1 | 1 | | 1 | 1 | | | |
| 196 | | | 1 | | 1 | 1 | | 1 | 1 | | | |
| 197 | 1 | | 1 | | 1 | 1 | | 1 | 1 | | | |
| 198 | | 1 | 1 | | 1 | 1 | | 1 | 1 | | | |
| 199 | 1 | 1 | 1 | | 1 | 1 | | 1 | 1 | | | |
| 200 | | | | 1 | 1 | 1 | | 1 | 1 | | | |
| 201 | 1 | | | 1 | 1 | 1 | | 1 | 1 | | | |
| 202 | | 1 | | 1 | 1 | 1 | | 1 | 1 | | | |
| 203 | 1 | 1 | | 1 | 1 | 1 | | 1 | 1 | | | |
| 204 | | | 1 | 1 | 1 | 1 | | 1 | 1 | | | |

TABLE 5

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 205 | 1 | | 1 | 1 | 1 | 1 | | 1 | 1 | | | |
| 206 | | 1 | 1 | 1 | 1 | 1 | | 1 | 1 | | | |
| 207 | 1 | 1 | 1 | 1 | 1 | 1 | | 1 | 1 | | | |
| 208 | | | | | 1 | | 1 | 1 | 1 | | | |
| 209 | 1 | | | | 1 | | 1 | 1 | 1 | | | |
| 210 | | 1 | | | 1 | | 1 | 1 | 1 | | | |
| 211 | 1 | 1 | | | 1 | | 1 | 1 | 1 | | | |
| 212 | | | 1 | | 1 | | 1 | 1 | 1 | | | |
| 213 | 1 | | 1 | | 1 | | 1 | 1 | 1 | | | |
| 214 | | 1 | 1 | | 1 | | 1 | 1 | 1 | | | |
| 215 | 1 | 1 | 1 | | 1 | | 1 | 1 | 1 | | ● | 40 |
| 216 | | | | 1 | 1 | | 1 | 1 | 1 | | | |
| 217 | 1 | | | 1 | 1 | | 1 | 1 | 1 | | | |
| 218 | | 1 | | 1 | 1 | | 1 | 1 | 1 | | | |
| 219 | 1 | 1 | | 1 | 1 | | 1 | 1 | 1 | | | |
| 220 | | | 1 | 1 | 1 | | 1 | 1 | 1 | | | |
| 221 | 1 | | 1 | 1 | 1 | | 1 | 1 | 1 | | | |
| 222 | | 1 | 1 | 1 | 1 | | 1 | 1 | 1 | | | |
| 223 | 1 | 1 | 1 | 1 | 1 | | 1 | 1 | 1 | | | |
| 224 | | | | | | 1 | 1 | 1 | 1 | | | |
| 225 | 1 | | | | | 1 | 1 | 1 | 1 | | | |
| 226 | | 1 | | | | 1 | 1 | 1 | 1 | | | |
| 227 | 1 | 1 | | | | 1 | 1 | 1 | 1 | | | |
| 228 | | | 1 | | | 1 | 1 | 1 | 1 | | | |
| 229 | 1 | | 1 | | | 1 | 1 | 1 | 1 | | | |
| 230 | | 1 | 1 | | | 1 | 1 | 1 | 1 | | | |
| 231 | 1 | 1 | 1 | | | 1 | 1 | 1 | 1 | | | |

TABLE 5-continued

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 332 | | | | 1 | | 1 | 1 | 1 | 1 | | | |
| 233 | 1 | | | 1 | | 1 | 1 | 1 | 1 | | | |
| 234 | | 1 | | 1 | | 1 | 1 | 1 | 1 | | | |
| 235 | 1 | 1 | | 1 | | 1 | 1 | 1 | 1 | | | |
| 236 | | | 1 | 1 | | 1 | 1 | 1 | 1 | | | |
| 237 | 1 | | 1 | 1 | | 1 | 1 | 1 | 1 | | | |
| 238 | | 1 | 1 | 1 | | 1 | 1 | 1 | 1 | | | |
| 239 | 1 | 1 | 1 | 1 | | 1 | 1 | 1 | 1 | | | |
| 240 | | | | | 1 | 1 | 1 | 1 | 1 | | | |
| 241 | 1 | | | | 1 | 1 | 1 | 1 | 1 | | | |
| 242 | | 1 | | | 1 | 1 | 1 | 1 | 1 | | | |
| 243 | 1 | 1 | | | 1 | 1 | 1 | 1 | 1 | | | |
| 244 | | | 1 | | 1 | 1 | 1 | 1 | 1 | | | |
| 245 | 1 | | 1 | | 1 | 1 | 1 | 1 | 1 | | | |
| 246 | | 1 | 1 | | 1 | 1 | 1 | 1 | 1 | | | |
| 247 | 1 | 1 | 1 | | 1 | 1 | 1 | 1 | 1 | | | |
| 248 | | | | 1 | 1 | 1 | 1 | 1 | 1 | | | |
| 249 | 1 | | | 1 | 1 | 1 | 1 | 1 | 1 | | | |
| 250 | | 1 | | 1 | 1 | 1 | 1 | 1 | 1 | | | |
| 251 | 1 | 1 | | 1 | 1 | 1 | 1 | 1 | 1 | | | |
| 252 | | | 1 | 1 | 1 | 1 | 1 | 1 | 1 | | | |
| 253 | 1 | | 1 | 1 | 1 | 1 | 1 | 1 | 1 | | | |
| 254 | | 1 | 1 | 1 | 1 | 1 | 1 | 1 | 1 | | | |
| 255 | 1 | 1 | 1 | 1 | 1 | 1 | 1 | 1 | 1 | ● | | |

TABLE 6

Example of Gray Scale Display with 9 Subfields
(Display-use Gray Scale in which one or less of subfields lighter than the emittig heaviest subfield is not emitted)

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 0 | | | | | | | | | | ● | | |
| 1 | 1 | | | | | | | | | ● | | |
| 2 | | 1 | | | | | | | | ● | | |
| 3 | 1 | 1 | | | | | | | | ● | | |
| 4 | | | 1 | | | | | | | | ● | 1 |
| 5 | 1 | | 1 | | | | | | | ● | | |
| 6 | | 1 | 1 | | | | | | | ● | | |
| 7 | 1 | 1 | 1 | | | | | | | ● | | |
| 8 | | | | 1 | | | | | | | | |
| 9 | 1 | | | 1 | | | | | | | ● | 2 |
| 10 | | 1 | | 1 | | | | | | | | |
| 11 | 1 | 1 | | 1 | | | | | | ● | | |
| 12 | | | 1 | 1 | | | | | | | ● | 1 |
| 13 | 1 | | 1 | 1 | | | | | | ● | | |
| 14 | | 1 | 1 | 1 | | | | | | ● | | |
| 15 | 1 | 1 | 1 | 1 | | | | | | ● | | |
| 16 | | | | | 1 | | | | | | | |
| 17 | 1 | | | | 1 | | | | | | | |
| 18 | | 1 | | | 1 | | | | | | | |
| 19 | 1 | 1 | | | 1 | | | | | | ● | 4 |
| 20 | | | 1 | | 1 | | | | | | | |
| 21 | 1 | | 1 | | 1 | | | | | | | |
| 22 | | 1 | 1 | | 1 | | | | | | | |
| 23 | 1 | 1 | 1 | | 1 | | | | | ● | | |
| 24 | | | | 1 | 1 | | | | | | | |
| 25 | 1 | | | 1 | 1 | | | | | | ● | 2 |
| 26 | | 1 | | 1 | 1 | | | | | | | |
| 27 | 1 | 1 | | 1 | 1 | | | | | ● | | |
| 28 | | | 1 | 1 | 1 | | | | | | ● | 1 |
| 29 | 1 | | 1 | 1 | 1 | | | | | ● | | |
| 30 | | 1 | 1 | 1 | 1 | | | | | ● | | |

TABLE 6-continued

Example of Gray Scale Display with 9 Subfields
(Display-use Gray Scale in which one or less of subfields lighter than the emittig heaviest subfield is not emitted)

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 31 | 1 | 1 | 1 | 1 | 1 | | | | | ● | | |
| 32 | | | | | | 1 | | | | | | |
| 33 | 1 | | | | | 1 | | | | | | |
| 34 | | 1 | | | | 1 | | | | | | |
| 35 | 1 | 1 | | | | 1 | | | | | | |
| 36 | | | 1 | | | 1 | | | | | | |
| 37 | 1 | | 1 | | | 1 | | | | | | |
| 38 | | 1 | 1 | | | 1 | | | | | | |
| 39 | 1 | 1 | 1 | | | 1 | | | | | ● | 8 |
| 40 | | | | 1 | | 1 | | | | | | |
| 41 | 1 | | | 1 | | 1 | | | | | | |
| 42 | | 1 | | 1 | | 1 | | | | | | |
| 43 | 1 | 1 | | 1 | | 1 | | | | | | |
| 44 | | | 1 | 1 | | 1 | | | | | | |
| 45 | 1 | | 1 | 1 | | 1 | | | | | | |
| 46 | | 1 | 1 | 1 | | 1 | | | | | | |
| 47 | 1 | 1 | 1 | 1 | | 1 | | | | ● | | |
| 48 | | | | | 1 | 1 | | | | | | |

TABLE 7

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 49 | 1 | | | | 1 | 1 | | | | | | |
| 50 | | 1 | | | 1 | 1 | | | | | | |
| 51 | 1 | 1 | | | 1 | 1 | | | | | ● | 4 |
| 52 | | | 1 | | 1 | 1 | | | | | | |
| 53 | 1 | | 1 | | 1 | 1 | | | | | | |
| 54 | | 1 | 1 | | 1 | 1 | | | | | | |
| 55 | 1 | 1 | 1 | | 1 | 1 | | | | ● | | |
| 56 | | | | 1 | 1 | 1 | | | | | | |
| 57 | 1 | | | 1 | 1 | 1 | | | | | ● | 2 |
| 58 | | 1 | | 1 | 1 | 1 | | | | | | |
| 59 | 1 | 1 | | 1 | 1 | 1 | | | | ● | | |
| 60 | | | 1 | 1 | 1 | 1 | | | | | ● | 1 |
| 61 | 1 | | 1 | 1 | 1 | 1 | | | | ● | | |
| 62 | | 1 | 1 | 1 | 1 | 1 | | | | ● | | |
| 63 | 1 | 1 | 1 | 1 | 1 | 1 | | | | ● | | |
| 64 | | | | | 1 | | 1 | | | | | |
| 65 | 1 | | | | 1 | | 1 | | | | | |
| 66 | | 1 | | | 1 | | 1 | | | | | |
| 67 | 1 | 1 | | | 1 | | 1 | | | | | |
| 68 | | | 1 | | 1 | | 1 | | | | | |
| 69 | 1 | | 1 | | 1 | | 1 | | | | | |
| 70 | | 1 | 1 | | 1 | | 1 | | | | | |
| 71 | 1 | 1 | 1 | | 1 | | 1 | | | | ● | 8 |
| 72 | | | | 1 | 1 | | 1 | | | | | |
| 73 | 1 | | | 1 | 1 | | 1 | | | | | |
| 74 | | 1 | | 1 | 1 | | 1 | | | | | |
| 75 | 1 | 1 | | 1 | 1 | | 1 | | | | | |
| 76 | | | 1 | 1 | 1 | | 1 | | | | | |
| 77 | 1 | | 1 | 1 | 1 | | 1 | | | | | |
| 78 | | 1 | 1 | 1 | 1 | | 1 | | | | | |
| 79 | 1 | 1 | 1 | 1 | 1 | | 1 | | | ● | | |
| 80 | | | | | | 1 | 1 | | | | | |
| 81 | 1 | | | | | 1 | 1 | | | | | |
| 82 | | 1 | | | | 1 | 1 | | | | | |
| 83 | 1 | 1 | | | | 1 | 1 | | | | | |
| 84 | | | 1 | | | 1 | 1 | | | | | |
| 85 | 1 | | 1 | | | 1 | 1 | | | | | |

TABLE 7-continued

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 86 | | 1 | 1 | | | 1 | 1 | | | | | |
| 87 | 1 | 1 | 1 | | | 1 | 1 | | | | ● | 8 |
| 88 | | | | 1 | | 1 | 1 | | | | | |
| 89 | 1 | | | 1 | | 1 | 1 | | | | | |
| 90 | | 1 | | 1 | | 1 | 1 | | | | | |
| 91 | 1 | 1 | | 1 | | 1 | 1 | | | | | |
| 92 | | | 1 | 1 | | 1 | 1 | | | | | |
| 93 | 1 | | 1 | 1 | | 1 | 1 | | | | | |
| 94 | | 1 | 1 | 1 | | 1 | 1 | | | | | |
| 95 | 1 | 1 | 1 | 1 | | 1 | 1 | | | ● | | |
| 96 | | | | | 1 | 1 | 1 | | | | | |
| 97 | 1 | | | | 1 | 1 | 1 | | | | | |
| 98 | | 1 | | | 1 | 1 | 1 | | | | | |
| 99 | 1 | 1 | | | 1 | 1 | 1 | | | | ● | 4 |
| 100 | | | 1 | | 1 | 1 | 1 | | | | | |

TABLE 8

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 101 | 1 | | 1 | | 1 | 1 | 1 | | | | | |
| 102 | | 1 | 1 | | 1 | 1 | 1 | | | | | |
| 103 | 1 | 1 | 1 | | 1 | 1 | 1 | | | ● | | |
| 104 | | | | 1 | 1 | 1 | 1 | | | | | |
| 105 | 1 | | | 1 | 1 | 1 | 1 | | | | ● | 2 |
| 106 | | 1 | | 1 | 1 | 1 | 1 | | | | | |
| 107 | 1 | 1 | | 1 | 1 | 1 | 1 | | | ● | | |
| 108 | | | 1 | 1 | 1 | 1 | 1 | | | | ● | 1 |
| 109 | 1 | | 1 | 1 | 1 | 1 | 1 | | | ● | | |
| 110 | | 1 | 1 | 1 | 1 | 1 | 1 | | | ● | | |
| 111 | 1 | 1 | 1 | 1 | 1 | 1 | 1 | | | ● | | |
| 112 | | | | | 1 | 1 | | 1 | | | | |
| 113 | 1 | | | | 1 | 1 | | 1 | | | | |
| 114 | | 1 | | | 1 | 1 | | 1 | | | | |
| 115 | 1 | 1 | | | 1 | 1 | | 1 | | | | |
| 116 | | | 1 | | 1 | 1 | | 1 | | | | |
| 117 | 1 | | 1 | | 1 | 1 | | 1 | | | | |
| 118 | | 1 | 1 | | 1 | 1 | | 1 | | | | |
| 119 | 1 | 1 | 1 | | 1 | 1 | | 1 | | | ● | 8 |
| 120 | | | | 1 | 1 | 1 | | 1 | | | | |
| 121 | 1 | | | 1 | 1 | 1 | | 1 | | | | |
| 122 | | 1 | | 1 | 1 | 1 | | 1 | | | | |
| 123 | 1 | 1 | | 1 | 1 | 1 | | 1 | | | | |
| 124 | | | 1 | 1 | 1 | 1 | | 1 | | | | |
| 125 | 1 | | 1 | 1 | 1 | 1 | | 1 | | | | |
| 126 | | 1 | 1 | 1 | 1 | 1 | | 1 | | | | |
| 127 | 1 | 1 | 1 | 1 | 1 | 1 | | 1 | | ● | | |
| 128 | | | | | 1 | | 1 | 1 | | | | |
| 129 | 1 | | | | 1 | | 1 | 1 | | | | |
| 130 | | 1 | | | 1 | | 1 | 1 | | | | |
| 131 | 1 | 1 | | | 1 | | 1 | 1 | | | | |
| 132 | | | 1 | | 1 | | 1 | 1 | | | | |
| 133 | 1 | | 1 | | 1 | | 1 | 1 | | | | |
| 134 | | 1 | 1 | | 1 | | 1 | 1 | | | | |
| 135 | 1 | 1 | 1 | | 1 | | 1 | 1 | | | ● | 8 |
| 136 | | | | 1 | 1 | | 1 | 1 | | | | |
| 137 | 1 | | | 1 | 1 | | 1 | 1 | | | | |
| 138 | | 1 | | 1 | 1 | | 1 | 1 | | | | |
| 139 | 1 | 1 | | 1 | 1 | | 1 | 1 | | | | |
| 140 | | | 1 | 1 | 1 | | 1 | 1 | | | | |
| 141 | 1 | | 1 | 1 | 1 | | 1 | 1 | | | | |
| 142 | | 1 | 1 | 1 | 1 | | 1 | 1 | | | | |
| 143 | 1 | 1 | 1 | 1 | 1 | | 1 | 1 | | ● | | |
| 144 | | | | | | 1 | 1 | 1 | | | | |
| 145 | 1 | | | | | 1 | 1 | 1 | | | | |

TABLE 8-continued

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 146 | | 1 | | | | 1 | 1 | 1 | | | | |
| 147 | 1 | 1 | | | | 1 | 1 | 1 | | | | |
| 148 | | | 1 | | | 1 | 1 | 1 | | | | |
| 149 | 1 | | 1 | | | 1 | 1 | 1 | | | | |
| 150 | | 1 | 1 | | | 1 | 1 | 1 | | | | |
| 151 | 1 | 1 | 1 | | | 1 | 1 | 1 | | | ● | 8 |
| 152 | | | | 1 | | 1 | 1 | 1 | | | | |

TABLE 9

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 153 | 1 | | | 1 | | 1 | 1 | 1 | | | | |
| 154 | | 1 | | 1 | | 1 | 1 | 1 | | | | |
| 155 | 1 | 1 | | 1 | | 1 | 1 | 1 | | | | |
| 156 | | | 1 | 1 | | 1 | 1 | 1 | | | | |
| 157 | 1 | | 1 | 1 | | 1 | 1 | 1 | | | | |
| 158 | | 1 | 1 | 1 | | 1 | 1 | 1 | | | | |
| 159 | 1 | 1 | 1 | 1 | | 1 | 1 | 1 | | ● | | |
| 160 | | | | | 1 | 1 | 1 | 1 | | | | |
| 161 | 1 | | | | 1 | 1 | 1 | 1 | | | | |
| 162 | | 1 | | | 1 | 1 | 1 | 1 | | | | |
| 163 | 1 | 1 | | | 1 | 1 | 1 | 1 | | | ● | 4 |
| 164 | | | 1 | | 1 | 1 | 1 | 1 | | | | |
| 165 | 1 | | 1 | | 1 | 1 | 1 | 1 | | | | |
| 166 | | 1 | 1 | | 1 | 1 | 1 | 1 | | | | |
| 167 | 1 | 1 | 1 | | 1 | 1 | 1 | 1 | | ● | | |
| 168 | | | | 1 | 1 | 1 | 1 | 1 | | | | |
| 169 | 1 | | | 1 | 1 | 1 | 1 | 1 | | | ● | 2 |
| 170 | | 1 | | 1 | 1 | 1 | 1 | 1 | | | | |
| 171 | 1 | 1 | | 1 | 1 | 1 | 1 | 1 | | ● | | |
| 172 | | | 1 | 1 | 1 | 1 | 1 | 1 | | | ● | 1 |
| 173 | 1 | | 1 | 1 | 1 | 1 | 1 | 1 | | ● | | |
| 174 | | 1 | 1 | 1 | 1 | 1 | 1 | 1 | | ● | | |
| 175 | 1 | 1 | 1 | 1 | 1 | 1 | 1 | 1 | | ● | | |
| 176 | | | | | 1 | 1 | 1 | | 1 | | | |
| 177 | 1 | | | | 1 | 1 | 1 | | 1 | | | |
| 178 | | 1 | | | 1 | 1 | 1 | | 1 | | | |
| 179 | 1 | 1 | | | 1 | 1 | 1 | | 1 | | | |
| 180 | | | 1 | | 1 | 1 | 1 | | 1 | | | |
| 181 | 1 | | 1 | | 1 | 1 | 1 | | 1 | | | |
| 182 | | 1 | 1 | | 1 | 1 | 1 | | 1 | | | |
| 183 | 1 | 1 | 1 | | 1 | 1 | 1 | | 1 | | ● | 8 |
| 184 | | | | 1 | 1 | 1 | 1 | | 1 | | | |
| 185 | 1 | | | 1 | 1 | 1 | 1 | | 1 | | | |
| 186 | | 1 | | 1 | 1 | 1 | 1 | | 1 | | | |
| 187 | 1 | 1 | | 1 | 1 | 1 | 1 | | 1 | | | |
| 188 | | | 1 | 1 | 1 | 1 | 1 | | 1 | | | |
| 189 | 1 | | 1 | 1 | 1 | 1 | 1 | | 1 | | | |
| 190 | | 1 | 1 | 1 | 1 | 1 | 1 | | 1 | | | |
| 191 | 1 | 1 | 1 | 1 | 1 | 1 | 1 | | 1 | ● | | |
| 192 | | | | | 1 | 1 | | 1 | 1 | | | |
| 193 | 1 | | | | 1 | 1 | | 1 | 1 | | | |
| 194 | | 1 | | | 1 | 1 | | 1 | 1 | | | |
| 195 | 1 | 1 | | | 1 | 1 | | 1 | 1 | | | |
| 196 | | | 1 | | 1 | 1 | | 1 | 1 | | | |
| 197 | 1 | | 1 | | 1 | 1 | | 1 | 1 | | | |
| 198 | | 1 | 1 | | 1 | 1 | | 1 | 1 | | | |
| 199 | 1 | 1 | 1 | | 1 | 1 | | 1 | 1 | | ● | 8 |
| 200 | | | | 1 | 1 | 1 | | 1 | 1 | | | |
| 201 | 1 | | | 1 | 1 | 1 | | 1 | 1 | | | |
| 202 | | 1 | | 1 | 1 | 1 | | 1 | 1 | | | |
| 203 | 1 | 1 | | 1 | 1 | 1 | | 1 | 1 | | | |
| 204 | | | 1 | 1 | 1 | 1 | | 1 | 1 | | | |

TABLE 10

| Gray Scale Level | Subfield 1 (1) | 2 (2) | 3 (4) | 4 (8) | 5 (16) | 6 (32) | 7 (48) | 8 (64) | 9 (80) | Display-use Gray Scale | Ditherd Gray Scale | Dither Value |
|---|---|---|---|---|---|---|---|---|---|---|---|---|
| 205 | 1 | | 1 | 1 | 1 | 1 | | 1 | 1 | | | |
| 206 | | 1 | 1 | 1 | 1 | 1 | | 1 | 1 | | | |
| 207 | 1 | 1 | 1 | 1 | 1 | 1 | | 1 | 1 | ● | | |
| 208 | | | | | 1 | | 1 | 1 | 1 | | | |
| 209 | 1 | | | | 1 | | 1 | 1 | 1 | | | |
| 210 | | 1 | | | 1 | | 1 | 1 | 1 | | | |
| 211 | 1 | 1 | | | 1 | | 1 | 1 | 1 | | | |
| 212 | | | 1 | | 1 | | 1 | 1 | 1 | | | |
| 213 | 1 | | 1 | | 1 | | 1 | 1 | 1 | | | |
| 214 | | 1 | 1 | | 1 | | 1 | 1 | 1 | | | |
| 215 | 1 | 1 | 1 | | 1 | | 1 | 1 | 1 | | ● | 8 |
| 216 | | | | 1 | 1 | | 1 | 1 | 1 | | | |
| 217 | 1 | | | 1 | 1 | | 1 | 1 | 1 | | | |
| 218 | | 1 | | 1 | 1 | | 1 | 1 | 1 | | | |
| 219 | 1 | 1 | | 1 | 1 | | 1 | 1 | 1 | | | |
| 220 | | | 1 | 1 | 1 | | 1 | 1 | 1 | | | |
| 221 | 1 | | 1 | 1 | 1 | | 1 | 1 | 1 | | | |
| 222 | | 1 | 1 | 1 | 1 | | 1 | 1 | 1 | | | |
| 223 | 1 | 1 | 1 | 1 | 1 | | 1 | 1 | 1 | ● | | |
| 224 | | | | | | 1 | 1 | 1 | 1 | | | |
| 225 | 1 | | | | | 1 | 1 | 1 | 1 | | | |
| 226 | | 1 | | | | 1 | 1 | 1 | 1 | | | |
| 227 | 1 | 1 | | | | 1 | 1 | 1 | 1 | | | |
| 228 | | | 1 | | | 1 | 1 | 1 | 1 | | | |
| 229 | 1 | | 1 | | | 1 | 1 | 1 | 1 | | | |
| 230 | | 1 | 1 | | | 1 | 1 | 1 | 1 | | | |
| 231 | 1 | 1 | 1 | | | 1 | 1 | 1 | 1 | | ● | 8 |
| 232 | | | | 1 | | 1 | 1 | 1 | 1 | | | |
| 233 | 1 | | | 1 | | 1 | 1 | 1 | 1 | | | |
| 234 | | 1 | | 1 | | 1 | 1 | 1 | 1 | | | |
| 235 | 1 | 1 | | 1 | | 1 | 1 | 1 | 1 | | | |
| 236 | | | 1 | 1 | | 1 | 1 | 1 | 1 | | | |
| 237 | 1 | | 1 | 1 | | 1 | 1 | 1 | 1 | | | |
| 238 | | 1 | 1 | 1 | | 1 | 1 | 1 | 1 | | | |
| 239 | 1 | 1 | 1 | 1 | | 1 | 1 | 1 | 1 | ● | | |
| 240 | | | | | 1 | 1 | 1 | 1 | 1 | | | |
| 241 | 1 | | | | 1 | 1 | 1 | 1 | 1 | | | |
| 242 | | 1 | | | 1 | 1 | 1 | 1 | 1 | | | |
| 243 | 1 | 1 | | | 1 | 1 | 1 | 1 | 1 | | ● | 4 |
| 244 | | | 1 | | 1 | 1 | 1 | 1 | 1 | | | |
| 245 | 1 | | 1 | | 1 | 1 | 1 | 1 | 1 | | | |
| 246 | | 1 | 1 | | 1 | 1 | 1 | 1 | 1 | | | |
| 247 | 1 | 1 | 1 | | 1 | 1 | 1 | 1 | 1 | ● | | |
| 248 | | | | 1 | 1 | 1 | 1 | 1 | 1 | | | |
| 249 | 1 | | | 1 | 1 | 1 | 1 | 1 | 1 | | ● | 2 |
| 250 | | 1 | | 1 | 1 | 1 | 1 | 1 | 1 | | | |
| 251 | 1 | 1 | | 1 | 1 | 1 | 1 | 1 | 1 | ● | | |
| 252 | | | 1 | 1 | 1 | 1 | 1 | 1 | 1 | | ● | 1 |
| 253 | 1 | | 1 | 1 | 1 | 1 | 1 | 1 | 1 | ● | | |
| 254 | | 1 | 1 | 1 | 1 | 1 | 1 | 1 | 1 | ● | | |
| 255 | 1 | 1 | 1 | 1 | 1 | 1 | 1 | 1 | 1 | ● | | |

What is claimed is:

1. A display apparatus for performing gray scale display by dividing one field of an image into a plurality of weighted subfields and by controlling each subfield to one of emit and not emit light based on a gray scale level of a pixel in the image, said apparatus comprising:

a converter for selectively converting the gray scale level of the pixel to one of a gray scale level in a first gray scale group or a gray scale level in a second gray scale group, said first gray scale group including a plurality of gray scale levels to be used for actual display, the gray scale level in the first gray scale group being expressed by a combination of the subfields, said second gray scale group including a plurality of gray scale levels each of which is interspersed in the gray scale levels in the first gray scale group; and a first diffuser for generating a video signal, said video signal displaying a gray scale level obtained by the converter when the gray scale level obtained by the converter is in the first gray scale group, and when the gray scale level obtained by the converter is in the second gray scale group, the diffuser generating a video signal displaying a gray scale level obtained by diffusing a predetermined value corresponding to the gray scale level in the second gray scale group.

2. The apparatus according to claim 1, wherein the first gray scale group includes gray scale levels each of which is achieved by subfields in which there is no non-emitting subfields in subfields having weights less than a greatest weight among weights of the subfields to be emitted for achieving the gray scale level.

3. The apparatus according to claim 1, wherein the first gray scale group includes gray scale levels each of which is achieved by subfields in which there is at most one non-emitting subfield in the subfields having weights less than a greatest weight among weights of the subfields to be emitted for achieving the gray scale level.

4. The apparatus according to claim 1, wherein the first gray scale group includes gray scale levels each of which is achieved by subfields in which there is at most two non-emitting subfields in subfields having weights less than a greatest weight among weights of the subfields to be emitted for achieving the gray scale level.

5. The apparatus according to claim 2, wherein said non-emitting subfield excludes a subfield having a minimum weight.

6. The apparatus according to claim 3, wherein said non-emitting subfield excludes a subfield having a minimum weight.

7. The apparatus according to claim 4, wherein said non-emitting subfield excludes a subfield having a minimum weight.

8. The apparatus according to claim 2, wherein said non-emitting subfield excludes a subfield having a minimum weight and a subfield having a next succeeding minimum weight.

9. The apparatus according to claim 3, wherein said non-emitting subfield excludes a subfield having a minimum weight and a subfield having a next succeeding minimum weight.

10. The apparatus according to claim 4, wherein said non-emitting subfield excludes a subfield having a minimum weight and a subfield having a next succeeding minimum weight.

11. The apparatus according to claim 2, wherein said non-emitting subfield excludes a subfield having a minimum weight, a subfield having a next succeeding minimum weight and a subfield having a third succeeding minimum weight.

12. The apparatus according to claim 3, wherein said non-emitting subfield excludes a subfield having a minimum weight, a subfield having a next succeeding minimum weight and a subfield having a third succeeding minimum weight.

13. The apparatus according to claim 4, wherein said non-emitting subfield excludes a subfield having a minimum weight, a subfield having a next succeeding minimum weight and a subfield having a third succeeding minimum weight.

14. The apparatus according to claim 1, wherein the first diffuser generates the video signal to display the gray scale level in the first gray scale group which is obtained by one of adding and subtracting a value corresponding to the gray scale to be displayed to or from the gray scale level in the second gray scale group when the converted gray scale level from the gray scale converter is in the second gray scale group.

15. The apparatus according to claim 1, further comprising a second diffuser for diffusing a difference between the gray scale level of a pixel to be displayed and the converted gray scale level of pixels adjacent to the pixel to be displayed with a predetermined ratio.

16. The apparatus according to claim 15, wherein the second diffuser determines a value to be diffused in a vertical direction based on a value obtained by removing the lower bits from a difference between the gray scale level of the pixel to be displayed and the converted gray scale level.

17. A display method for performing gray scale display by dividing one field of an image into a plurality of weighted subfields and by controlling each subfield to one of emit and not emit light based on a gray scale level of a pixel in the image, said method comprising:

selectively converting a gray scale level of the pixel to one of a gray scale level in a first gray scale group and or a gray scale level in a second gray scale group, said first gray scale group including a plurality of gray scale levels for actual display, the gray scale level in the first gray scale group being expressed by a combination of the subfields, said second gray scale group including a plurality of gray scale levels each of which is interspersed in the gray scale levels in the first gray scale group; and generating a video signal, said video signal displaying a gray scale level obtained by the conversion when the gray scale level obtained by the conversion is in the first gray scale group, and when the gray scale level obtained by the conversion is in the second gray scale group, generating a video signal displaying a gray scale level which is obtained by diffusing a predetermined value corresponding to the gray scale level in the second gray scale group.

18. The method according to claim 17, wherein the first gray scale group includes gray scale levels each of which is achieved by subfields in which there is no non-emitting subfields in subfields having weights less than a greatest weight among weights of the subfields to be emitted for achieving the gray scale level.

19. The method according to claim 17, wherein the first gray scale group includes gray scale levels each of which is achieved by subfields in which there is at most one non-emitting subfield in subfields having weights less than a greatest weight among weights of the subfields to be emitted for achieving the gray scale level.

20. The method according to claim 17, wherein the first gray scale group includes gray scale levels each of which is achieved by subfields in which there is at most two non-emitting subfields in subfields having weights less than a greatest weight among weights of the subfields to be emitted for achieving the gray scale level.

21. The method according to claim 18, wherein said non-emitting subfield excludes a subfield having the minimum weight.

22. The method according to claim 19, wherein said non-emitting subfield excludes a subfield having the minimum weight.

23. The method according to claim 20, wherein said non-emitting subfield excludes a subfield having the minimum weight.

24. The method according to claim 18, wherein said non-emitting subfield excludes a subfield having a minimum weight and a subfield having the next succeeding minimum weight.

25. The method according to claim 19, wherein said non-emitting subfield excludes a subfield having a minimum weight and a subfield having a next succeeding minimum weight.

26. The method according to claim 20, wherein said non-emitting subfield excludes a subfield having a minimum weight and a subfield having a next succeeding minimum weight.

27. The method according to claim 18, wherein said non-emitting subfield excludes a subfield having a minimum weight, a subfield having a next succeeding minimum weight and a subfield having a third succeeding minimum weight.

28. The method according to claim 19, wherein said non-emitting subfield excludes a subfield having a minimum weight, a subfield having a next succeeding minimum weight and a subfield having a third succeeding minimum weight.

29. The method according to claim 20, wherein said non-emitting subfield excludes a subfield having a minimum weight, a subfield having a next succeeding minimum weight and a having a third succeeding minimum weight.

30. The method according to claim 17, wherein the generating the video signal to display the gray scale level in the first gray scale group which is obtained by one of adding and subtracting a value corresponding to the gray scale to be displayed to or from the gray scale level in the second gray scale group when the converted gray scale level from the gray scale conversion is in the second gray scale group.

31. The method according to claim 17, further comprising diffusing a difference between the gray scale level of a pixel to be displayed and the converted gray scale level of pixels adjacent to the pixel to be displayed with a predetermined ratio.

32. The method according to claim 31, wherein the diffusing determines a value to be diffused in a horizontal direction based on lower bits of all bits which indicate the gray scale level of a pixel to be displayed, and a value to be diffused in a vertical direction based on a value obtained by removing the lower bits from a difference between the gray scale level of the pixel to be displayed and the converted gray scale level.

* * * * *

UNITED STATES PATENT AND TRADEMARK OFFICE

CERTIFICATE OF CORRECTION

PATENT NO. : 6,965,358 B1
APPLICATION NO. : 09/623452
DATED : November 15, 2005
INVENTOR(S) : M. Kasahara et al.

It is certified that error appears in the above-identified patent and that said Letters Patent is hereby corrected as shown below:

On Title Page, at Item (75), Inventors, "Tbaraki" should be --Ibaraki--.

At column 33, line 12, (claim 29, line 4) of the printed patent, before "having" insert --subfield--.

Signed and Sealed this

Eleventh Day of July, 2006

JON W. DUDAS
*Director of the United States Patent and Trademark Office*